US011111763B2

(12) United States Patent
Shields

(10) Patent No.: US 11,111,763 B2
(45) Date of Patent: Sep. 7, 2021

(54) TEMPERATURE RESPONSIVE FRACTURING

(71) Applicant: Austin J Shields, Houston, TX (US)

(72) Inventor: Austin J Shields, Houston, TX (US)

( * ) Notice: Subject to any disclaimer, the term of this patent is extended or adjusted under 35 U.S.C. 154(b) by 0 days.

(21) Appl. No.: 16/261,685

(22) Filed: Jan. 30, 2019

(65) Prior Publication Data

US 2019/0345801 A1 Nov. 14, 2019

Related U.S. Application Data

(60) Provisional application No. 62/668,859, filed on May 9, 2018.

(51) Int. Cl.

| | |
|---|---|
| ***E21B 43/117*** | (2006.01) |
| ***E21B 29/02*** | (2006.01) |
| ***E21B 34/06*** | (2006.01) |
| ***E21B 43/24*** | (2006.01) |
| ***E21B 43/26*** | (2006.01) |

(Continued)

(52) U.S. Cl.

CPC ..... *E21B 43/117* (2013.01); *E21B 29/02* (2013.01); *E21B 34/06* (2013.01); *E21B 43/2405* (2013.01); *E21B 43/26* (2013.01); *E21B 43/261* (2013.01); *E21B 34/066* (2013.01); *E21B 43/267* (2013.01); *E21B 47/07* (2020.05); *E21B 2200/06* (2020.05)

(58) Field of Classification Search

CPC .... E21B 43/2405; E21B 34/06; E21B 36/001; E21B 29/02; E21B 2034/007; E21B 47/065; E21B 43/26; E21B 43/17; E21B 43/247; E21B 43/261; E21B 43/267; E21B 43/283; E21B 34/066

See application file for complete search history.

(56) References Cited

U.S. PATENT DOCUMENTS 2,712,455 A 7/1955 Neilon
3,880,236 A * 4/1975 Durning ..... E21B 36/003 166/302

(Continued)

FOREIGN PATENT DOCUMENTS

EP 1930541 A2 6/2008
WO WO2015181541 A2 12/2015

OTHER PUBLICATIONS

Electronic Sliding Sleeve for Unlimited Zone Multistage Completion System; Matt Merron, et al.; SPE-187204-MS; Oct. 2017.

*Primary Examiner* — Taras P Bemko
*Assistant Examiner* — Jonathan Malikasim
(74) *Attorney, Agent, or Firm* — Billy C. Allen, III

(57) ABSTRACT

Fracturing a well can include disposing within the well a plurality of temperature responsive devices including a trigger circuit. The devices may be configured to establish fluid communication through a casing of the well or isolate a section of the well responsive to a downhole temperature, a number of downhole temperature cycles, and/or a time delay. The devices may operate by triggering an explosive and/or initiating at least one of a thermal, incendiary, or chemical cutting device. The devices can perforating sleeves adapted to be installed over a casing joint, subs adapted to be threaded between two casing joints, perforating devices embedded within a casing joint, isolation mechanisms, or toe valves.

22 Claims, 16 Drawing Sheets

(51) Int. Cl.
*E21B 43/267* (2006.01)
*E21B 47/07* (2012.01)

(56) References Cited

U.S. PATENT DOCUMENTS

| | | | | |
|---|---|---|---|---|
| 4,511,374 | A * | 4/1985 | Heath | B01D 19/0068 95/18 |
| 4,832,121 | A * | 5/1989 | Anderson | E21B 43/26 166/250.09 |
| 5,159,145 | A | 10/1992 | Carisella | |
| 6,053,111 | A | 4/2000 | Motley | |
| 6,962,202 | B2 | 11/2005 | Bell | |
| 7,461,580 | B2 | 12/2008 | Bell | |
| 9,010,442 | B2 * | 4/2015 | Streich | E21B 34/063 166/374 |
| 9,085,969 | B2 | 7/2015 | Clay et al. | |
| 9,249,650 | B2 * | 2/2016 | Bruce | E21B 36/00 |
| 9,745,823 | B2 * | 8/2017 | Wood | E21B 43/14 |
| 2004/0134658 | A1 | 7/2004 | Bell | |
| 2005/0263286 | A1 | 12/2005 | Sheffield | |
| 2009/0205826 | A1 * | 8/2009 | Rodriguez | C09K 8/80 166/280.2 |
| 2010/0314562 | A1 | 12/2010 | Bisset | |
| 2014/0083689 | A1 | 3/2014 | Streich | |
| 2014/0262234 | A1 | 9/2014 | Walton et al. | |

* cited by examiner

TEMPERATURE RESPONSIVE FRACTURING

BACKGROUND

Horizontal shale wells have historically required pumping large volumes of water and sand to fracture the rock. The effectiveness of the fracturing may rely on a series of independent stages that are isolated from each other by pressure barriers. The method of isolation can vary from well to well, but the industry has gravitated towards plug and perf operations due to positive correlations between the number of fracture initiation points and well production. To create fracture initiation points, a tubular metal wire line gun may be loaded with explosives, then pumped from the surface to a desired downhole location where the charges may be set off by sending an electrical signal down the wire from surface. The electric signal can selectively set off the detonators (the primary explosive) that may be connected to the charges via a primer cord. A plug may be run in the hole below the perforating guns and set before the first gun of each stage is fired, thereby isolating the previous stage from the next stage to be fractured. Each stage may be defined by a set of individual clusters and a total amount of water and sand that is pumped downhole simultaneously into the clusters. Mechanically, the steps of this process have remained relatively unchanged since wire line pump down operations began.

While the basic steps of the perforating process have not changed, many details of the process have. For example, operators have discovered that increasing the number of fracture initiation points by pumping significantly more sand and water into more clusters can increase the value of the production streams beyond the associated added costs. As a result, the number of clusters per fracture stage, the number of stages, and thus the total number of clusters per well has increased significantly over time.

As the number of stages has increased, it has become increasingly important to reduce the amount of time between stages. When a single well is fractured, the entire hydraulic fracture equipment spread must wait for the wire line operation to finish so that pumping can begin. This could be up to 2.5 hours or more for the deepest stages in a well. When two wells are zipper fractured (one is being fractured while the other undergoes wire line operations), this time can be reduced to 30 to 90 minutes depending on onsite procedures and equipment maintenance. However, in some cases, theoretical time savings from zipper fracturing wells may not be achieved because as the fracturing spread is run more consistently, wear and tear on the fluid ends of the frac pumps increases, which may result in minimal or negative savings from zippering the wells.

Fracturing initiation for the toe stage via toe valves can also present issues. First, toe valves may fail to open, or they may open and then become clogged with debris. In some cases operators may elect to perform a "toe preparation" process that involves mobilizing equipment to site and making sure that the toe valves work so that the more expensive hydraulic fracturing spread will not be forced to wait on malfunctioning toe valves. Toe valves can also restrict the inner diameter of the casing near the toe, necessitating more flexible wiper darts to be run, which can increase the chances of leaving excess cement in the well bore.

As an alternative to toe valves, some operators may perforate the toe of the well by running guns in the well on coiled tubing, a process known as TCP (tubing conveyed perforating). Using TCP, the operator can shoot the total desired number of clusters in the first stage, resulting in one fewer wire line trip to achieve the same total number of clusters in the well. TCP can also give more entry points into the well so that operators are less likely to plug off the openings with debris. Running TCP can also eliminate the need for casing ID restrictions at the toe of the well, increasing the likelihood of a successful cement job. However, TCP is dependent on coiled tubing availability and can be expensive. TCP may also not be able to reach deep enough to reach the toe of some extended lateral wells due to frictional limitations.

The foregoing challenges have led service companies to try alternative fracturing methods to replace the plug and perf process. However, the new techniques have, in general, been cost prohibitive. For example, pressure actuated sliding sleeves allow operators to move very quickly between stages by dropping a ball to seal off the old stage and shift the next stage's sleeve open. However, the higher number of fracture initiation points and lower cost of plug and perf completion designs rendered sliding sleeves unsuitable for many applications. Coil shifted sleeves have also been used, but such operations are very time consuming; adding moving equipment downhole increases the risk of failure. RFID (radio frequency identification) technology has also been applied to casing conveyed perforating, in which charges are run in on the outside of the casing, but these solutions required composite windows in the casing to allow for RF (radio frequency) communication through the casing. Added cost and complexity rendered this solution impractical as well. Thus, plug and perf remains a preferred industry technique for completing wells.

Thus, what is needed in the art are improvements to plug and perf completions that simplify operations so as to allow for reduced cost and reduced time.

SUMMARY

A method of fracturing a well can include disposing within the well a plurality of temperature responsive devices each comprising a trigger circuit configured to establish fluid communication through a casing of the well responsive to a downhole temperature and a number of downhole temperature cycles. The method can further include pumping a first frac stage, thereby lowering the downhole temperature for at least a predetermined time period, the lowering of the downhole temperature being detected by each of the trigger circuits. The method can further include stopping pumping of the first frac stage, thereby allowing the downhole temperature to increase, the increased temperature being detected by each of the trigger circuits. Each temperature responsive device, upon detecting a respective predetermined number of temperature cycles and a downhole temperature exceeding a respective predetermined temperature, can trigger establishment of fluid communication through the casing.

The downhole temperature can be at least one of a casing temperature or a wellbore fluid temperature. At least one of the plurality of temperature responsive device can trigger establishment of fluid communication through the casing by detonating an explosive. Detonating the explosive may create pressure to shift a sleeve or port. Detonating the explosive may further allow well pressure to shift an unbalanced piston. In some embodiments, establishment of fluid communication through the casing may include initiating at least one of a thermal, incendiary, or chemical cutting device.

The temperature responsive devices may include at least one temperature responsive perforating sleeve adapted to be installed over a casing joint. The temperature responsive devices may include at least one temperature responsive sub adapted to be threaded between two casing joints. The temperature responsive devices may include at least one temperature responsive perforating device embedded within a casing joint.

The method discussed above may further include disposing within the well at least one temperature responsive isolation mechanism wherein the temperature responsive isolation mechanism is used to form a pressure barrier between frac stages. The isolation mechanism may detonate an explosive, which may, in some embodiments, allow wellbore pressure to act on an unbalanced piston and, in at least some embodiments, create a pressure imbalance to shift a sleeve or port. In some embodiments, the isolation mechanism may create a ball seat.

The method may still further include, prior to pumping the first frac stage, triggering an explosive device of a temperature responsive device located at a toe of the well, the triggering being responsive to a predetermined amount of time above a predetermined temperature threshold detected by the temperature responsive device located at the toe of the well. In such cases, at least one trigger mechanism may be configured to trigger a respective explosive upon detecting a respective predetermined number of temperature cycles, a casing temperature exceeding a respective predetermined temperature, and a respective time delay.

A method of fracturing a well may alternatively or additionally include disposing within the well at least one temperature responsive isolation devices each comprising a trigger circuit configured to establish isolation between at least two well zones responsive to a downhole temperature and a number of downhole temperature cycles. The method may further include pumping a first frac stage, thereby lowering the downhole temperature for at least a predetermined time period, the lowering of the downhole temperature being detected by the at least one trigger circuits. The method may still further include stopping pumping of the first frac stage, thereby allowing the downhole temperature to increase, the increased temperature being detected by the at least one trigger circuits. At least one temperature responsive isolation device, upon detecting a respective predetermined number of temperature cycles and a downhole temperature exceeding a respective predetermined temperature, may triggers the isolation mechanism. Triggering the isolation mechanism may detonate an explosive. Detonation of the explosive may allow wellbore pressure to act on an unbalanced piston and may additionally or alternately create a pressure imbalance to shift a sleeve or port. The isolation mechanism creates a ball seat.

A method of fracturing a well may alternatively or additionally include disposing within the well a temperature responsive toe valve comprising a trigger circuit that opens the valve responsive to a downhole temperature above a predetermined temperature threshold for a predetermined period of time. Subsequent to the predetermined amount of time above a predetermined temperature, one or more frac stages may be pumped. The downhole temperature may be at least one of a casing temperature or a wellbore fluid temperature. The temperature responsive toe valve may open by detonating an explosive, which may create pressure to shift a sleeve or port, which may allow well pressure to shift an unbalanced piston. The temperature responsive toe valve may additionally or alternatively open by initiating at least one of a thermal, incendiary, or chemical cutting device.

A temperature responsive completion device may include an explosive and a trigger circuit configured to trigger the explosive responsive to a downhole temperature and at least one of a number of temperature cycles and a time period above or below a temperature threshold. The temperature responsive device may be a perforating sleeve adapted to be installed over a casing joint. The perforating sleeve is configured to be secured to the casing by welding, slips, and/or mechanical fasteners. The perforating sleeve may be located with respect to the casing by one or more pre-drilled holes in the casing. In other embodiments, the temperature responsive completion device may be a sub adapted to be threaded between two casing joints.

The temperature responsive completion device may also be a remote isolation mechanism. The isolation mechanism may detonate an explosive to create a pressure imbalance to shift a sleeve or port, including, for example by use of an unbalanced piston. In some embodiments, the isolation mechanism may create a ball seat.

The temperature responsive completion device may also be a toe valve. In such embodiments, the trigger circuit may be configured to trigger the explosive responsive to a downhole temperature above a predetermined temperature threshold for a predetermined time period.

In any of the foregoing embodiments, the trigger circuit may include a temperature sensor, a controller, and a plurality of capacitors. The explosive may be a shaped charge, including a unidirectional shaped charge or a bidirectional shaped charge, and the shaped charge may operate in conjunction with a rupture or burst disk.

DETAILED DESCRIPTION

Figure 1:
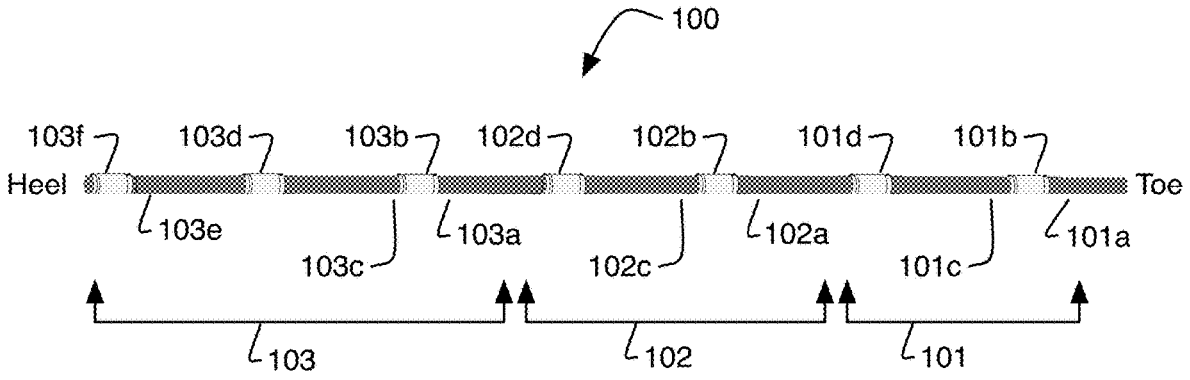
FIG. 1 illustrates a wellbore apparatus comprising a plurality of frac stages, each including multiple clusters.

In the following description, for purposes of explanation, numerous specific details are set forth to provide a thorough understanding of the disclosed concepts. As part of this description, some of this disclosure's drawings represent structures and devices in block diagram form for sake of simplicity. In the interest of clarity, not all features of an actual implementation are described in this disclosure. Moreover, the language used in this disclosure has been selected for readability and instructional purposes, has not been selected to delineate or circumscribe the disclosed subject matter. Rather the appended claims are intended for such purpose.

Various embodiments of the disclosed concepts are illustrated by way of example and not by way of limitation in the accompanying drawings in which like references indicate similar elements. For simplicity and clarity of illustration, where appropriate, reference numerals have been repeated among the different figures to indicate corresponding or analogous elements. In addition, numerous specific details are set forth in order to provide a thorough understanding of the implementations described herein. In other instances, methods, procedures and components have not been described in detail so as not to obscure the related relevant function being described. References to "an," "one," or "another" embodiment in this disclosure are not necessarily to the same or different embodiment, and they mean at least one. A given figure may be used to illustrate the features of more than one embodiment, or more than one species of the disclosure, and not all elements in the figure may be required for a given embodiment or species. A reference number, when provided in a given drawing, refers to the same element throughout the several drawings, though it may not be repeated in every drawing. The drawings are not to scale unless otherwise indicated, and the proportions of certain parts may be exaggerated to better illustrate details and features of the present disclosure.

Overview

FIG. 1 schematically depicts a wellbore apparatus 100 that may be used in a plug and perf operation. The wellbore apparatus includes a series of well casing joints 101*a*, 101*c*, 102*a*, 102*c*, 103*a*, 103*c*, and 103*e*. These casing joints are joined by a series of perforating sleeves 101*b*, 101*d*, 102*b*, 102*d*, 103*b*, 103*d*, and 103*f*. The perforating sleeves may be disposed around the casing joints, or may thread into the ends of the casing joints. Various perforating sleeve embodiments and their use are described in greater detail herein. Casing joint 101*a* is disposed at the "toe" of the wellbore assembly, i.e., at a most distal/furthest downhole end. Perforating sleeve 103*f* is located at the "heel" of the wellbore assembly, i.e., at a least distal/nearest the surface end. It will be appreciated that the illustrated wellbore assembly may be located in a vertical segment of the well, a horizontal segment of the well, and that the exact orientation of these segments may in fact be anywhere between truly horizontal and vertical. It will also be appreciated that a well may include multiple lateral segments, each containing a wellbore assembly similar to that illustrated in FIG. 1, or that the assembly may include more or fewer numbers of casing joints, stimulation zones (described below), and/or perforating sleeves.

So-called "plug and perf" fracturing operations may be enhanced by the use of casing conveyed perforating. In casing conveyed perforating, explosives are run into the well with the casing. For example, the explosives may be disposed in/on perforating sleeves like those described herein. These explosives may be triggered at the desired time to perforate the casing, allowing fluid communication between the well bore and the formation, allowing the initiation of fracturing. Initiating the explosives preferably includes communicating data (i.e., a trigger signal) through the steel casing to the various perforating sleeves disposed within the well. Preferably this communication can be performed without excessive power consumption to either send the initiating signal or receive and respond to the initiating signal on the outside of the casing. One way to achieve this goal is to use the temperature cycles that naturally occur as a part of fracturing operations to encode counter signals that can be received and decoded by receiver circuitry disposed in the perforating sleeve. In some embodiments, these same temperature cycles can be used to remotely actuate isolation mechanisms to provide down hole operations without wire line, coiled tubing, or other intervention from surface. The temperature that is monitored as the control input for this process may be a well casing temperature, a wellbore fluid temperature, or any other suitable downhole temperature. For purposes of the following description, operation of the device will be described in terms of casing temperature, but it will be understood that any other suitable downhole temperature may be used.

Figure 2:
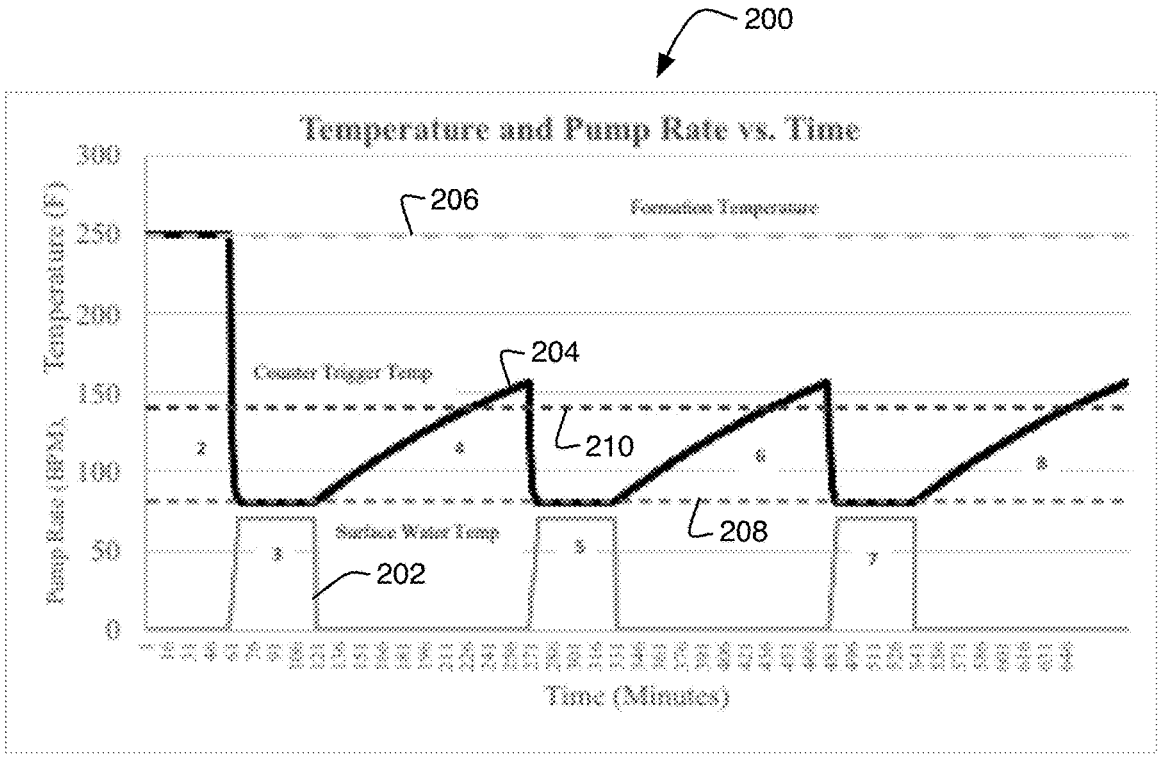
FIG. 2 illustrates wellbore apparatus temperatures for a plurality of frac stages.

A well's casing experiences temperature swings resulting from the relatively high temperature of the formation versus the relatively low temperature of the hydraulic fracturing water. This may be understood with reference to FIG. 2, which illustrates various temperatures associated with a fracturing operation. FIG. 2 illustrates a plot 200 illustrating an exemplary fracturing operation. Time is depicted on the x-axis, and flow rate (for curve 202) and temperature (for curves 204, 206, 208, and 210) are depicted on the y-axis. Curve 202 represents the flow of fracturing water for three pumping stages (3, 5, 7), with a flow rate of approximately 75 bbl/min during the frac and a flow rate of approximately zero during other times. Curve 204 represents the casing temperature over a corresponding series of non-pumping time periods (2, 4, 6, 8) and the same pumping periods (3, 5, 7). As can be seen, the casing temperature 204 in time period 2 starts out at a temperature of approximately 250 F, which corresponds to the formation temperature 206. As the first pumping stage (3) begins, the temperature drops rapidly to approximately 80 F, which corresponds to the temperature of the frac water 208. After a predetermined time below the low temperature threshold, the pumping stage may be detected as having been completed. Once the first pumping stage ends, the casing temperature begins increasing (4). Once the casing temperature 204 exceeds the counter trigger temperature 210 for a predetermined period of time, an explosive is triggered, opening new holes in the casing and formation, and a further pumping stage (5) begins, which drops the casing temperature 204 back to the frac water temperature 208. This cycle may repeat multiple times.

In some embodiments, a minimum time at or below a low temperature threshold may be detected and required as a condition of incrementing the cycle count. This time threshold relates to certain operating practices sometimes implemented in fracturing operations. For example, in some cases, pumping of a frac stage may be interrupted because of some operational issue. If, prior to the interruption, less than a certain amount of pumping had occurred, the operator may desire to re-frac the stage, i.e., to continue pumping into the current stage. Alternatively, if more than a certain amount of pumping had occurred, the operator may consider the frac of that stage to be "good enough" and may want to move on to the next stage. Thus, a minimum time at or below a low temperature threshold can allow the operator to either re-frac a current stage or move to the next stage as appropriate.

The heat transfer model of the casing may be readily understood with respect to the heat transfer coefficients of steel, cement, and shale. Steel has a relatively high heat transfer coefficient of about 43 W/(m-K). Cement has a relatively low heat transfer coefficient of about 0.29 W/(m-K). Shale rock of the formation on the outside of the casing may typically have a heat transfer coefficient higher than the cement but lower than steel. The heat transfer problem may thus be imagined as a pipe (the casing) with water (the fracturing water) flowing through it, wrapped in thermal insulation (cement), surrounded by an infinite heat source (the shale formation). During the pumping stages, because so much water is pumped (sometimes in excess of 5,000 bbls per stage), and because the water is at surface temperature, the steel casing quickly assumes nearly the same temperature as the surface water. The cement is the limiting factor in the heat transfer equation. Because of the insulating properties of the cement, there is never enough heat transferred from the shale formation to warm the casing because of the large amounts of water being pumped during the fracturing job. After a pumping stage is completed, the problem becomes a steady state heat transfer problem. During this non-pumping phase, the shale slowly transfers heat to the casing and the water contained therein, eventually bringing it up to the constant temperature of the shale formation. In the illustration of FIG. 2, the temperature after two hours of heating corresponds to the approximately 155 F temperature at the peaks of curve 204.

Understanding that the downhole temperatures will follow predictable "drop-then-rise" cycles as a result of frac stages being pumped allows a counter signal to be encoded in each cycle. The fracturing sleeves may use this counter signal, with each stage's set of clusters being individually keyed to send a detonation signal based on these well bore cycles. Certain clusters within a stage may be given a time delay to preferentially open a cluster or clusters in a certain order. This may allow time for other operations. For example, acid may be injected into the toe cluster and placed or "spotted" over the remaining clusters to ensure an efficient wellbore cleanup and stimulation.

In addition to having applications for use in multi-stage fracturing operations, a temperature actuated device may function to establish initial wellbore injection in the toe of the well, replacing the pressure actuated toe valves used in many wells today. In some wells, a device may be run in the toe of the well and programmed to open a pathway from the casing to the formation after a time delay and temperature threshold are both exceeded. This time delay may serve at least two functions. First, it may give the rig crew ample time to ensure that the casing is successfully run into position before actuation. Second, it may allow the operator time to pressure test casing integrity before beginning injection or fracture stimulation operations. The temperature threshold may be set so that once a certain temperature (corresponding to the well's bottom hole temperature) is exceeded, actuation and communication between the well and the formation is established to allow for the first toe injection stage to commence.

Turning back to FIG. 1, frac stage programming might look like the following, assuming an open toe valve or circulation point at the start. FIG. 1 shows three stages: Stage 1 (101), Stage 2 (102), and Stage 3 (103). Stages 1 and 2 each include two clusters, and stage 3 includes three clusters. (It will be appreciated that an actual implementation may include any number of stages, with each stage including any number of clusters.) In the illustrated embodiment, Stage 1 (101) includes casing joints 101*a* and 101*c* along with perforating sleeves 101*b* and 101*d*. Stage 2 (102) includes casing joints 102*a* and 102*c* along with perforating sleeves 102*b* and 102*d*. Stage 3 (103) includes casing joints 103*a*, 103*c*, and 103*e* along with perforating sleeves 103*b*, 103*d*, and 103*f* The clusters comprising each stage may be programmed as follows:

Stage 1: All clusters (i.e., perforating sleeves 101*b* and 101*d*) may be programmed to fire after one temperature drop and rise cycle (e.g., Zone 4 of FIG. 2).

Stage 3: All clusters (i.e., perforating sleeves 102*b* and 102*d*) may be programmed to fire after two temperature drop and rise cycles (e.g., Zone 6 of FIG. 2).

Stage 3: All clusters (i.e., perforating sleeves 103*b*, 103*d*, and 103*f*) may be programmed to fire after three temperature drop and rise cycles (e.g., zone 8 of FIG. 2).

Thus, the clusters may all be programmed at the same or similar temperature set point (e.g., temperature 210 in FIG. 2), with the clusters of each stage being set with a different number of temperature cycles triggering the perforating. In some embodiments, temperature set points may vary with well depth as required for a particular application or based on a particular well profile. In any case, this programming methodology allows selective perforating of each stage moving up the well bore. Omitted from the foregoing description is an isolation mechanism between the zones (as may be included in the fracturing operations). A remote isolation mechanism is described below; however, in a simple scenario, balls of different diameters may be dropped from the surfaces and may be caught by ball seats of increasing diameter (up the well) to form pressure seals in the conventional manner.

Mechanical Design

The perforating sleeves may be designed so as to be conveyed to the target zone of the wellbore along with (i.e., as part of) the well's casing. In some embodiments, the perforating sleeve may be a substantially cylindrical body either comprising a subassembly with box and pin threads so as to be connected between casing joints. In other embodiments, the perforating sleeve may be designed to be slipped over a casing joint and secured in place.

Figure 3A:
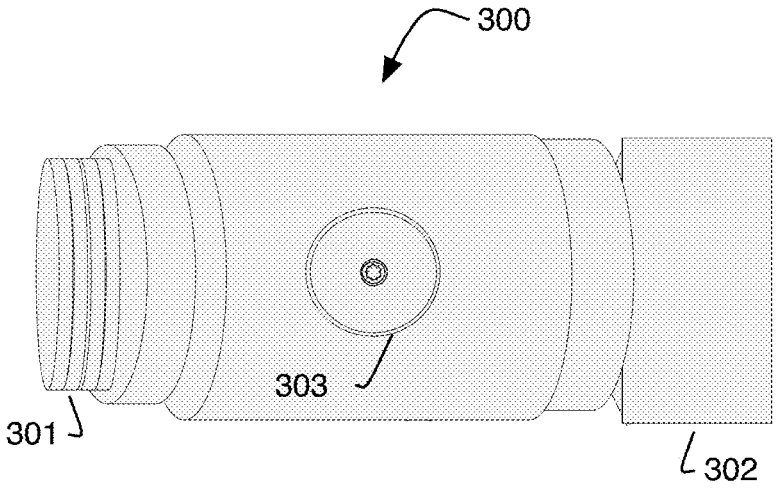
FIGS. 3A-3B illustrate an embodiment of a perforating sleeve.
Figure 3B:
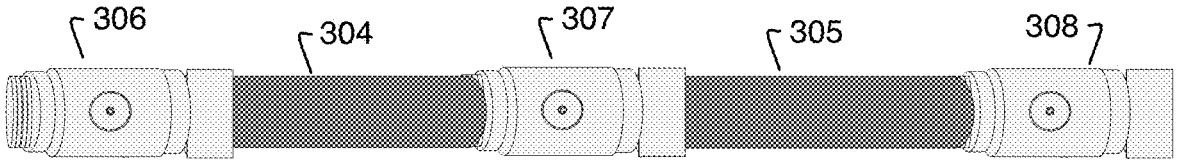

FIG. 3A illustrates an exemplary perforating sleeve 300 designed as a subassembly for threading into casing joints. Perforating sleeve 300 has at one end a pin thread 301 adapted to mate to a box thread of a first casing joint 304 (FIG. 3B). Perforating sleeve 300 has at the other end a box thread 302 adapted to mate to a pin thread of a second casing joint 305 (FIG. 3B). Perforating sleeve 300 also includes a port 303 for access to interior electronics and explosives. Perforating sleeve 300 can be run between regular or shortened casing joints (e.g., 304, 305, FIG. 3B) as part of the casing string. FIG. 3B illustrates multiple perforating sleeves 306, 307, and 308 being run with casing joints 304 and 305. If a longer string of perforations is desired, multiple perforating sleeves 300 may be used, or the perforating sleeves 300 could be lengthened to accommodate more explosives. The port may be deemed unnecessary in this arrangement and excluded from the sleeve design.

Figure 4:
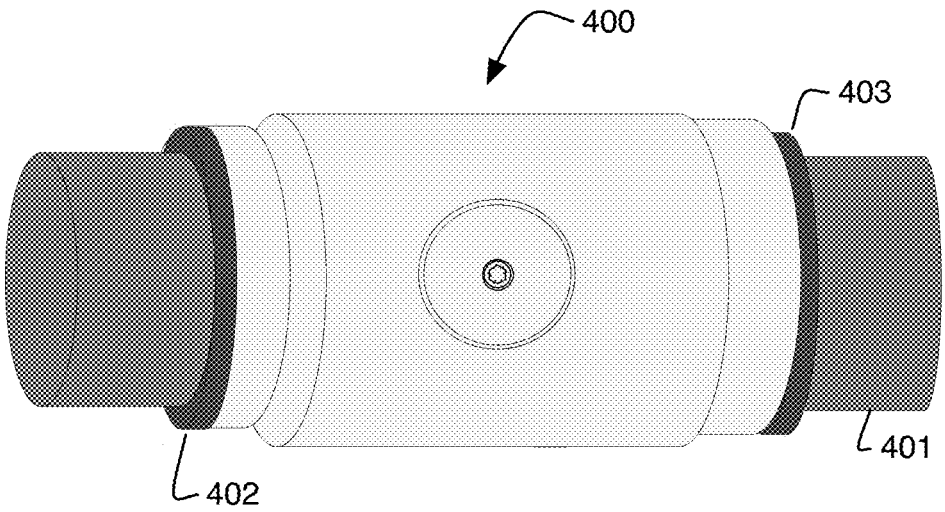
FIG. 4 illustrates an alternative embodiment of a perforating sleeve.

FIG. 4 illustrates an exemplary perforating sleeve 400 designed as a subassembly for slipping over a casing joint.

Perforating sleeve 400 is similar to perforating sleeve 300, except that the box and pin threads have been omitted. Instead of threading into the end of casing joints, perforating sleeve 400 is intended to be slipped over a casing joint 401. Thus, perforating sleeve 400 has an inside diameter that is slightly greater than the outside diameter of the casing with which it is intended to be used. Once perforating sleeve 400 is positioned at the desired location along casing joint 401, it may be secured to the casing joint by welds 402, 403. This allows for secure mechanical positioning as well as a pressure tight seal between perforating sleeve 400 and casing joint 401.

Figure 5:
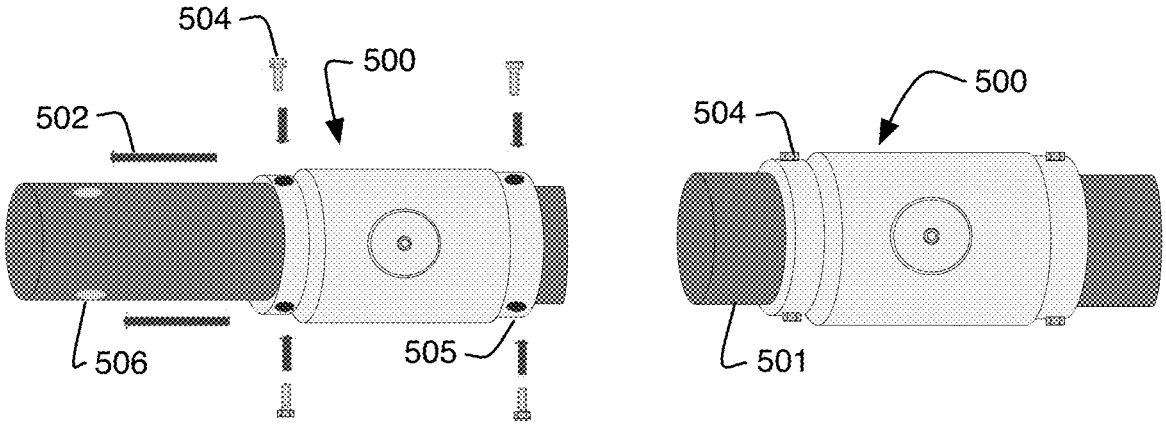
FIG. 5 illustrates another alternative embodiment of a perforating sleeve.

FIG. 5 illustrates a perforating sleeve 500 also designed as a subassembly for slipping over a casing joint 501. However, rather than being configured to be welded to the casing joint 501, perforating sleeve 500 is configured to be secured by mechanical fasteners 504. More specifically, perforating sleeve 500 may be slipped over casing joint 501 as indicated by directional arrows 502. Once in position, a plurality of fasteners 504 (bolts, screws, pins, etc.) may be positioned within holes 505 drilled through perforating sleeve 501. Optionally, holes 506 may be provided in casing 501 to provide additional security. These holes 506 may be drilled partially through the casing or may be drilled entirely through the casing. Additional seal elements, including either an elastomeric seal, a metal-metal seal, or other types/combinations of seals may also be provided to ensure pressure-tight connection between perforating sleeve 500 and casing joint 501.

Figure 6A:
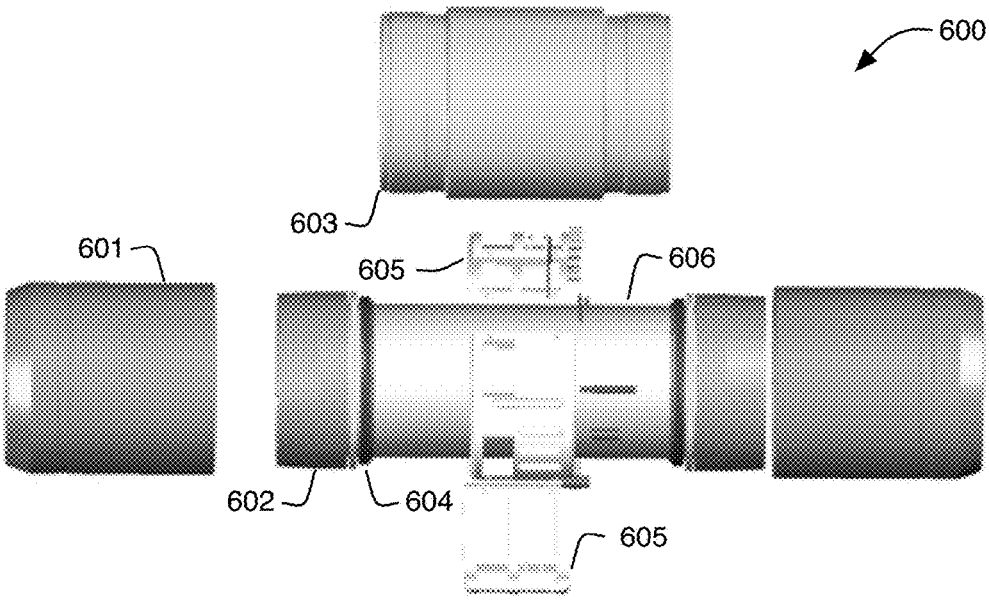
FIGS. 6A-6D illustrate still another embodiment of a perforating sleeve.

FIG. 6A illustrates an enlarged, exploded view of yet another perforating sleeve 600. Perforating sleeve 600 is configured to use slips 602 and seals 604 to secure perforating sleeve 600 to the casing 606. The housing of perforating sleeve 600 includes shoulders 601 and main chamber 603. Shoulders 601 may be located on either end of main chamber 603 and may be angled to facilitate smooth running into the wellbore. Slips 602, located at either end of main housing 603 wedge between the interior of shoulders 601 and casing joint 606 to secure perforating sleeve 600 to the casing as described in further detail below. Seals 604 may be energized by the same compression that secures slips 602, or they may be self-energized to ensure a pressure tight seal between main chamber 603 and casing 606. The control electronics and explosives (not pictured) may be contained within main chamber 603 and supported by interior supports 605. These supports may also provide support for casing 606 from burst and collapse pressure.

Figure 6B:
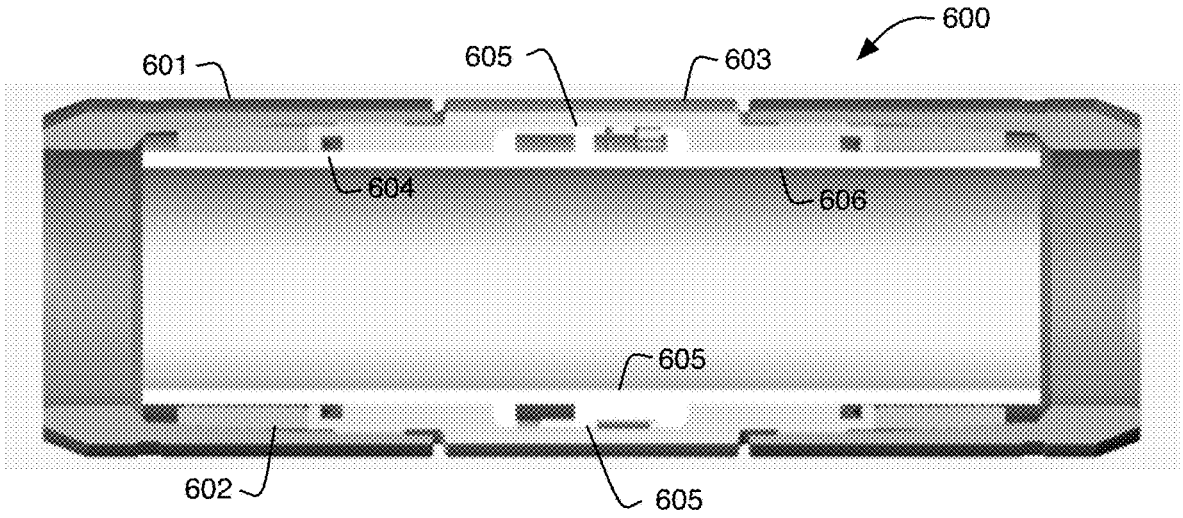

FIG. 6B illustrates a cutaway view of perforating sleeve 600 having the slip and seal design. More specifically, FIG. 6B illustrates a view of the engaged slips 602 and seals 604 together with the configuration of the interior supports 606 mounted inside main chamber 603. FIG. 6B omits the control electronics, batteries, and explosives for clarity.

Figure 6C:
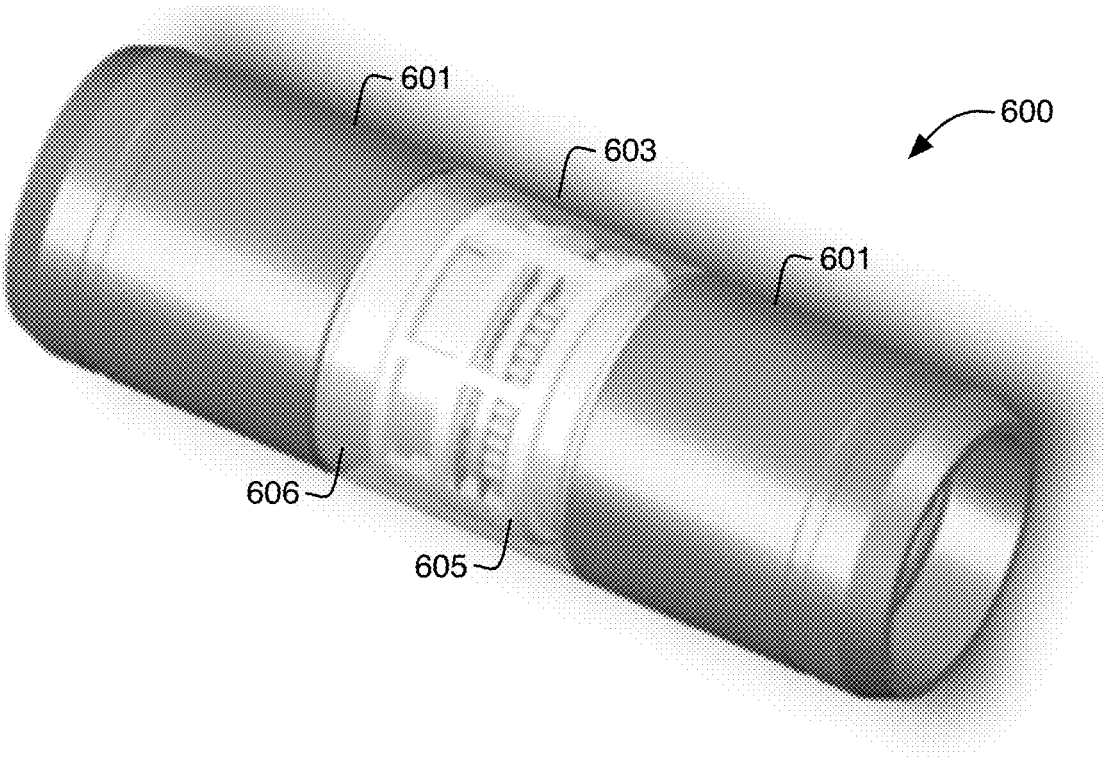

FIG. 6C illustrates perforating sleeve 600 with main chamber 603 drawn transparently. This allows one to see casing 606, and interior supports 605 and various electronic components (unlabeled), which allows the capacitors and the circuit board as well as the support tray 605, which is disposed around the casing 606 to be seen. As in the preceding figures, the shoulders are labeled 601 for reference.

Figure 6D:
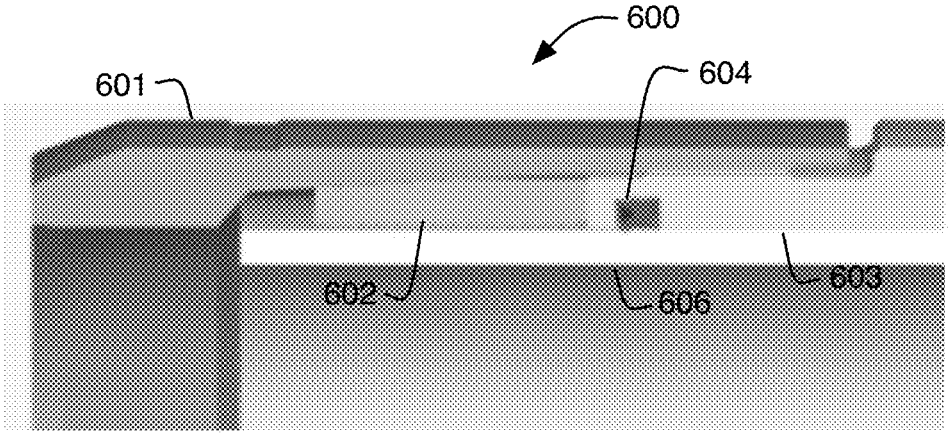

FIG. 6D illustrates a close-up view of slips 602 and seals 604 as illustrated in FIGS. 6A-6C. With the sleeve 600 positioned in the desired position on casing 606, slips 602 on either end of sleeve 600 may be engaged by screwing the shoulder caps to the housing, causing the angled surface of the shoulder to come into contact with the slips, pushing them to contact the casing to anchor sleeve 600 to casing 606. Slips 602 may be self-energized and provide a pressure barrier between main housing 603 of sleeve 600, containing the electronics and explosives, and the exterior wellbore.

Figure 7A:
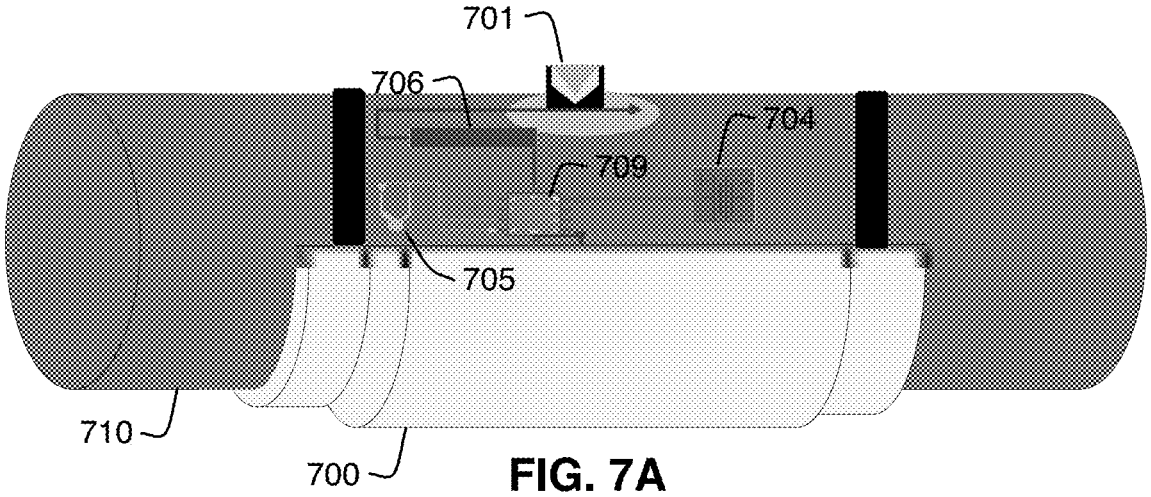
FIGS. 7A-7E schematically depict the control and actuating aspects of a perforating sleeve.
Figure 7B:
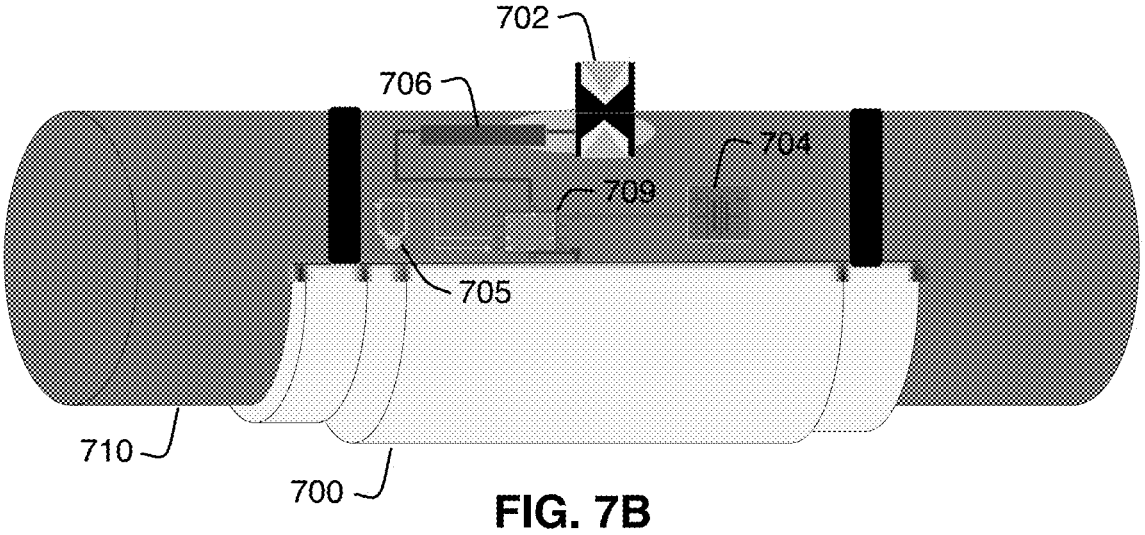
Figure 7C:
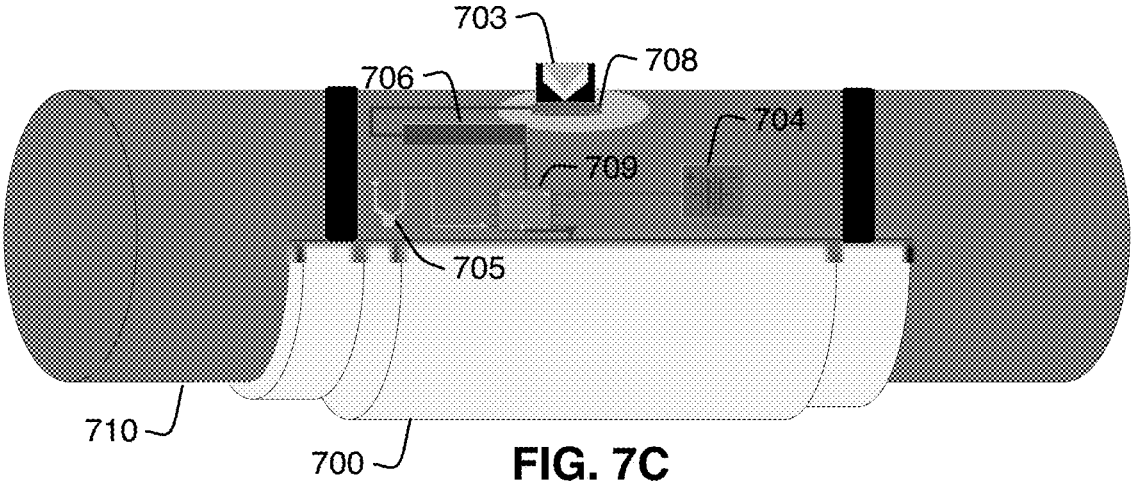
Figure 7D:
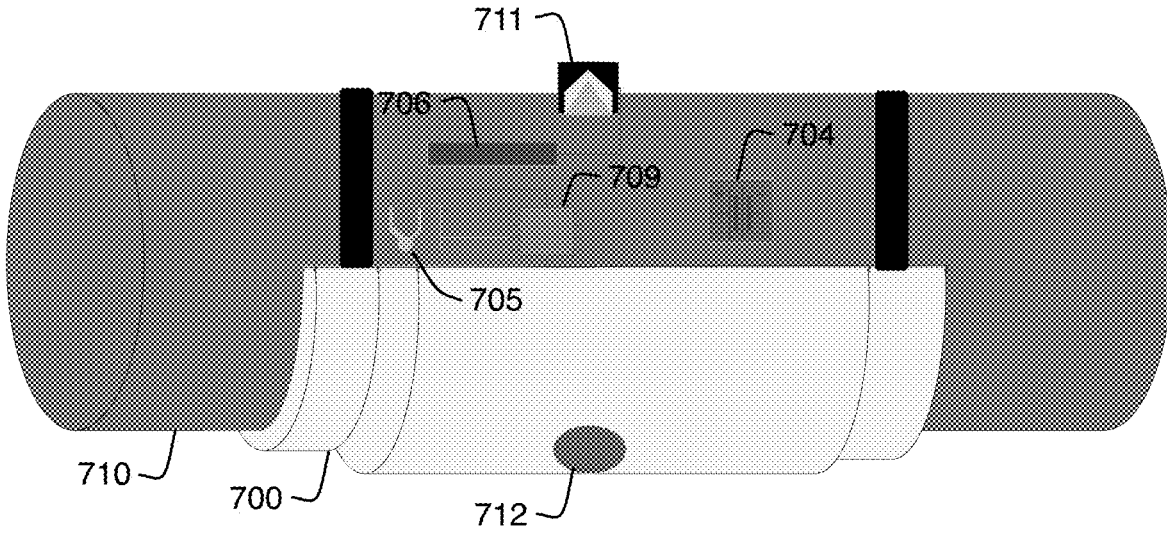
Figure 7E:
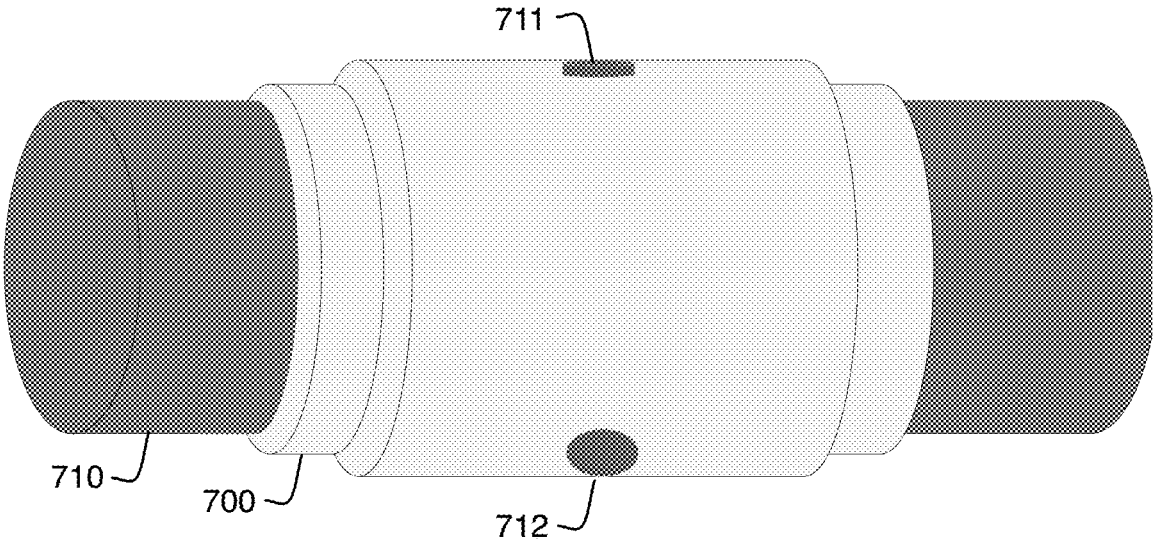

FIGS. 7A-7E are cutaway views of temperature responsive perforating sleeves 700 illustrating exemplary electronics and explosives configurations. The mechanical design of perforating sleeves 700 may be constructed according to any of the various embodiments described above with respect to FIGS. 3-6. In other words, any of the foregoing mechanical configurations may be used in any combination with any of the following electronics and explosives configurations. FIG. 7A illustrates a perforating sleeve 700 with a unidirectional shaped charge 701. FIG. 7B illustrates a perforating sleeve 700 with a bidirectional shaped charge 702. FIG. 7C illustrates a perforating sleeve 700 with a unidirectional shaped charge 703 (facing away from the casing) in conjunction with a burst disk 708 disposed on the casing. In FIG. 7D, a cutaway view illustrates a perforating sleeve with a unidirectional shaped charge 711 facing inward to the casing with a burst disk 712 integral to the exterior wall of the sleeve 700 and aligned with the shaped charge. FIG. 7E illustrates the same charge and burst disk configuration as FIG. 7D, but the view exterior to the sleeve is shown without cutaway.

In each embodiment, batteries 704 provide power to a controller 709 that monitors and records the temperature of casing 710 via a temperature sensor 705. Controller 709 may be formed from various combinations of integrated or discrete circuitry such as microcontrollers, microprocessors, digital signal processors and the like. When controller 709 detects the predetermined sequence of temperature changes for a given perforating sleeve, a trigger signal may be provided to detonate a primary explosive 706 (e.g., a detonator connected to detonation cord) that may in turn set off the secondary explosive, i.e., shaped charge 701/702/703/704. Additional circuitry may be provided as required. For example, capacitors may be provided that are charged by the trigger signal to initiate the explosion. Furthermore, in some embodiments, a single explosive, rather than a primary and secondary explosive may be used. The shaped charges may be mounted within the temperature responsive perforating sleeve's main chamber. Additionally, the charges may be embedded into the exterior of the casing and placed at an angle to decrease the overall profile of the perforating sleeve. In some embodiments, a 90 degree configuration and/or a non-cylindrical shaped charge may be used to achieve the desired exterior size and/or profile.

Figure 8A:
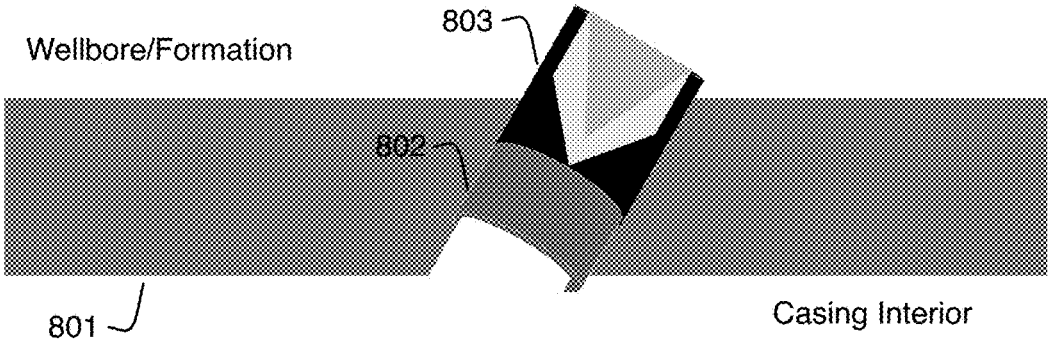
FIGS. 8A-8D depict explosives configurations for a perforating sleeve.
Figure 8B:
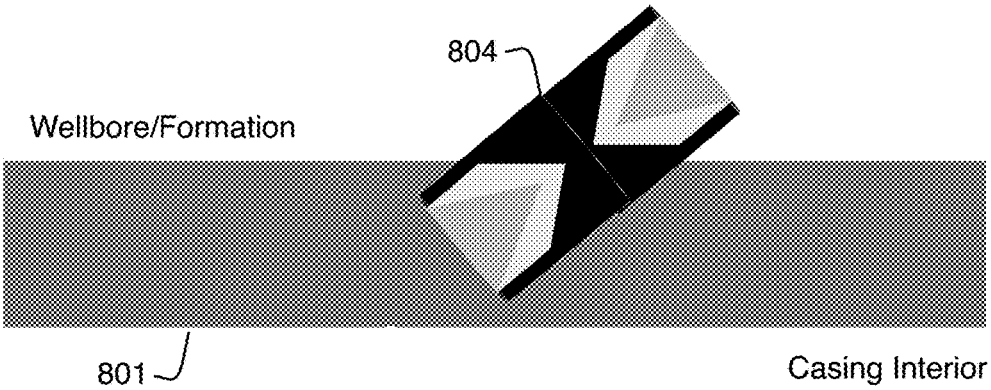
Figure 8C:
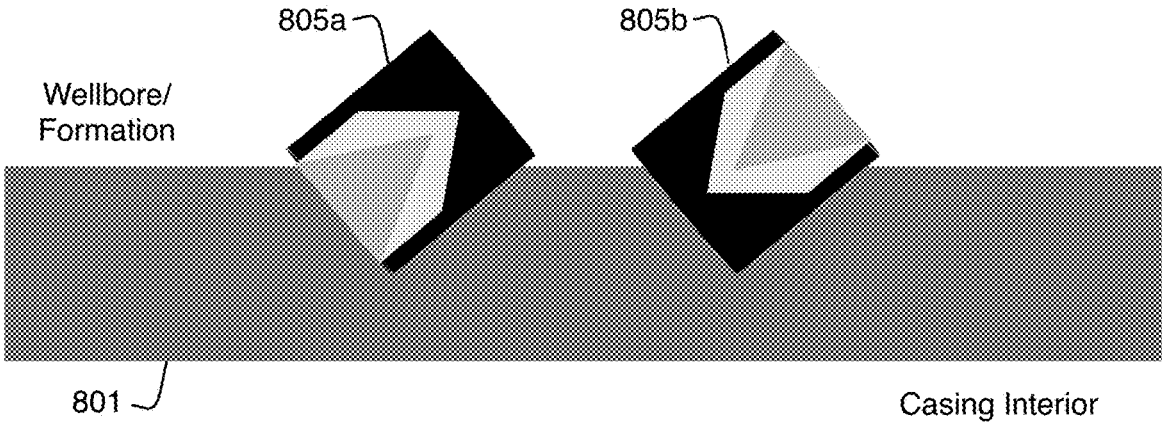
Figure 8D:
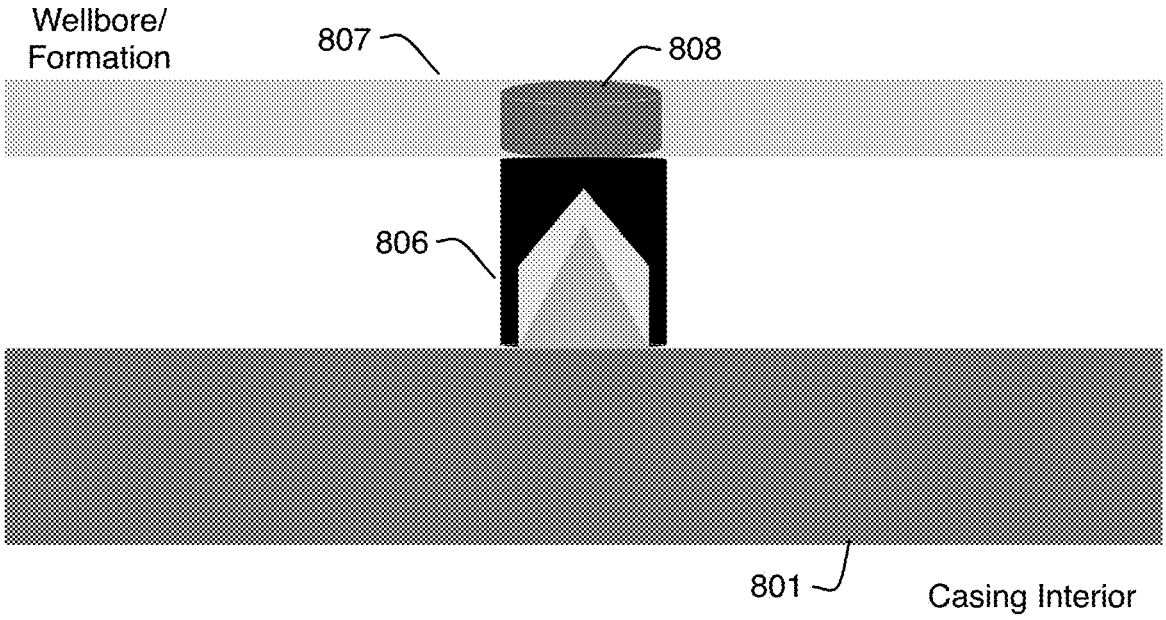

The secondary explosive (e.g., shaped charge) may be arranged such that on detonation it opens a hole through the casing, thereby providing fluid communication from the interior of the casing to the formation. FIGS. 8A-8D show an enlarged view of the four basic explosive configurations described above with respect to FIGS. 7A-7E. FIG. 8A illustrates a burst disk 802 disposed on the casing that may be used in conjunction with a shaped charge 803 as was described above with reference to FIG. 7C. When shaped charge 803 detonates outwardly through the exterior wall of the shell and into the surrounding cement and formation (not shown), burst disk 802 is destroyed, providing the fluid communication path between the interior of the casing and the wellbore/formation. FIG. 8B illustrates a bidirectional shaped charge 804 as was described above with respect to FIG. 7B. Bidirectional shaped charge shoots both inward through casing 801 and outward into the formation to establish he fluid communication path between the interior of the casing and the wellbore/formation. FIG. 8C displays multiple shaped charges 805*a* and 805*b*, pointing both inward (805*a*) to perforate casing 801 and outward (805*b*) to establish communication with the formation (not shown). FIG. 8D displays a burst disk 808 integral to the exterior wall of the sleeve's shell 807 (not pictured in 8A-8C). In 8D, the shaped charge 806 is pointed inward towards the casing 801.

Additionally, although embodiments showing shaped charges have been described herein, the devices described herein may alternatively or additionally use incendiary materials, "chemical cutters," or a combination of both to create a pathway for fracture fluid to flow from the casing to the formation. An incendiary based device may use a fuel or propellant to generate heat and pressure, creating holes in the casing for fracturing fluid flow. Incendiary materials may deflagrate as opposed to detonating. A chemical cutter based device may use an explosive charge and/or high pressure jets containing corrosive material to perforate the casing, which may be heated in the process. Bromine Trifluoride is commonly used as a reactive ingredient of a chemical cutter.

Figure 9A:
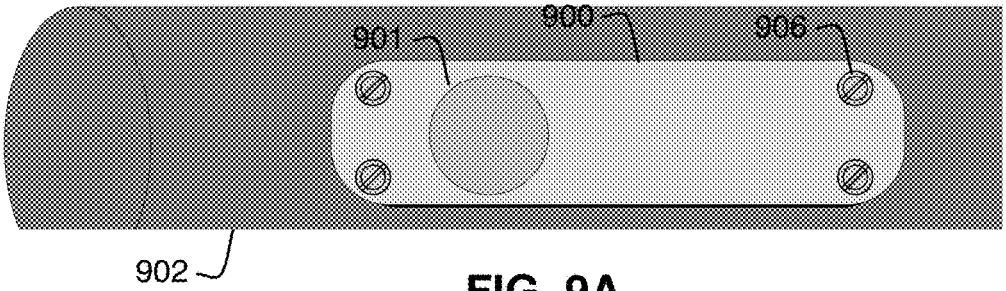
FIGS. 9A-9D depict a perforating sleeve using a pressure actuated piston.
Figure 9B:
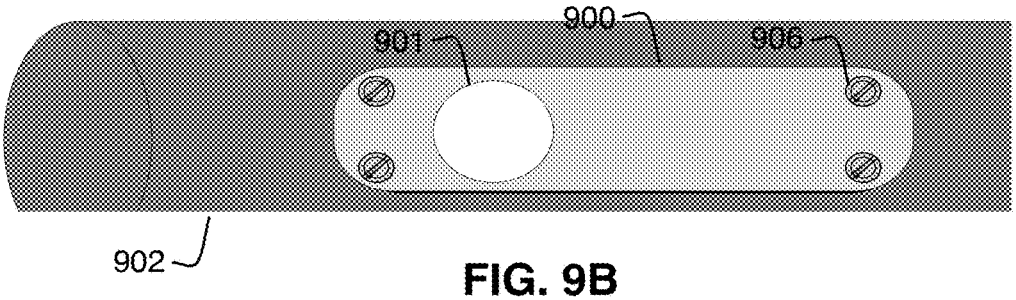

An alternative perforating sleeve design is illustrated in FIGS. 9A and 9B. The alternative perforating sleeve design may use a temperature actuated trigger protocol as described above, but instead of using explosives to directly penetrate the casing and formation, explosives may be used to create a pressure imbalance to shift open a port. FIGS. 9A and 9B show a top view of a perforating sleeve 900. FIG. 9A illustrates perforating sleeve 900 with port 901 in the closed position. FIG. 9B illustrates perforating sleeve 901 in the open position. In both cases, the perforating sleeve 900 is shown affixed to/embedded within a casing joint 902, as described further below with respect to FIGS. 9C and 9D.

Figure 9C:
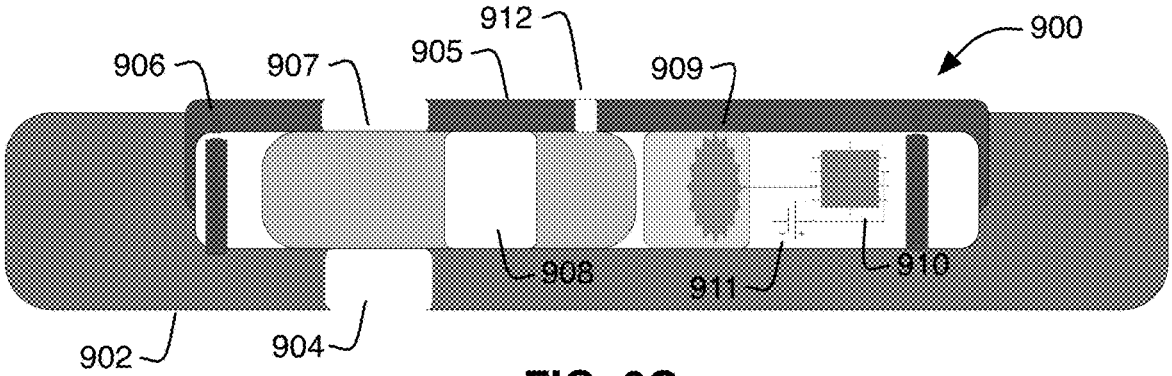
Figure 9D:
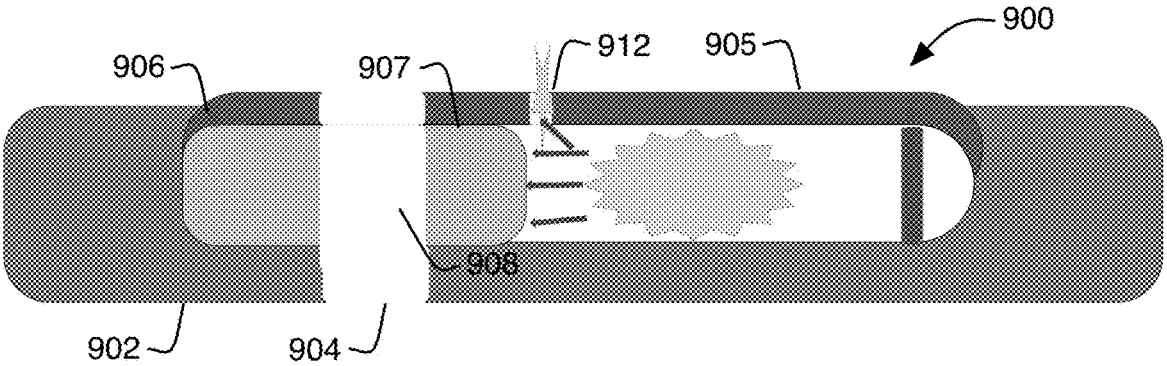

FIGS. 9C and 9D illustrate side views of perforating sleeve 901 sleeve embedded in the casing 902. Casing 902 may have a recess formed therein for receiving the sleeve 900. At least a portion 903 may penetrate the casing entirely, forming port 904. Perforating sleeve 900 may include a housing 905 disposed within the recess and secured to the casing by fasteners 906 (e.g., screws, bolts, etc.) Disposed within the housing may be a piston 907, having a port 908 machined therethrough. In the initial, run-in position, piston 907 may be located within the housing so that port 904 is blocked, preventing fluid communication between the interior and exterior of the casing. In the actuated position (described in greater detail below, the piston may be shifted so that piston port 908 aligns with casing port 904, permitting fluid communication between the interior and exterior of the casing.

Also contained within housing 905 is explosive 909. Explosive 909 may be connected to a controller 910, which may be powered by battery 911. Controller 910 may be a controller as described above, i.e., discrete components or an integrated microcontroller, microprocessor, or the like. Controller 910 may trigger explosive 909 in response to temperature changes as described above. Once explosive 909 is triggered, pressure can force piston 907 into the open position, in which piston port 908 aligns with casing port 904, allowing fluid communication between the casing interior and the wellbore. Excess pressure resulting from the explosion may be discharged through port 912. Port 912 may initially be blocked by piston 907 (indicated in FIG. 9C) and opened by piston 907 moving past the port. Alternatively, an additional port (not shown) may be formed in piston 907 that aligns with port 912 when the perforating sleeve is in the open position.

Figure 10A:
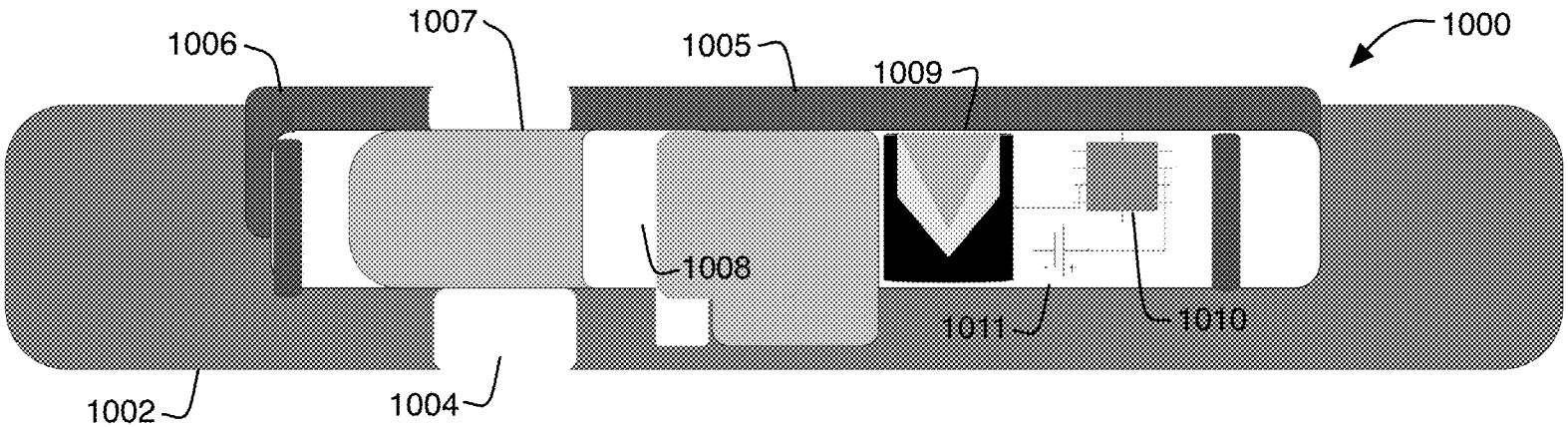
FIGS. 10A-10B depict an alternative perforating sleeve design using an unbalanced piston.
Figure 10B:
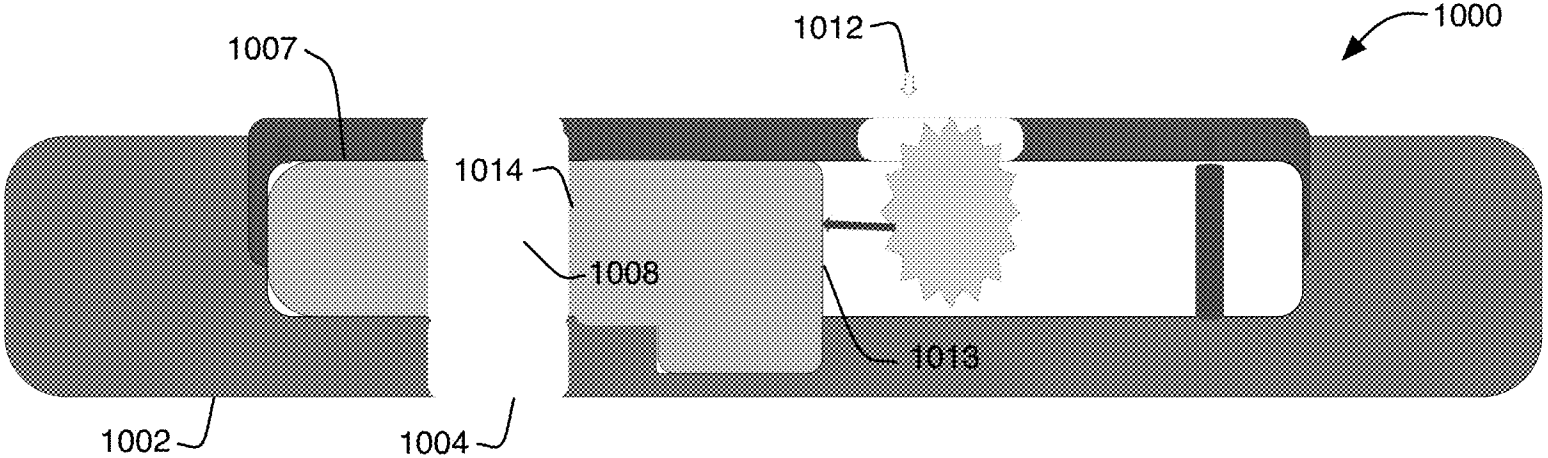

Still another alternative sleeve design is illustrated in FIGS. 10A and 10B. FIG. 10A shows the unbalanced piston design in the closed position, and FIG. 10B shows the unbalanced piston design in the open position. With reference to FIG. 10A, the construction is in general similar to the sleeve described above with respect to FIGS. 9A-9D. More specifically, a recess is formed in casing 1002 into which perforating sleeve 1000 is positioned. Perforating sleeve 1000 includes a housing 1005 that is secured to casing 1002 by fasteners 1006. Within housing 1005 is a piston 1007 having a port 1008 formed therethrough. In the closed position, the piston port 1008 is not aligned with casing port 1004.

Explosive 1009 may be triggered by a controller 1010, which is powered by battery 1011. The controller may operate in response to temperature as described above. When explosive 1009 is triggered, it may open a hole in housing 1005 allowing wellbore fluid 1012 to enter the recess. This exposure to wellbore pressure may displace piston 1007 (to the left as illustrated) aligning piston port 1008 with casing port 1004, thereby opening the sleeve. It will be appreciated that piston face 1013 must have a greater area than piston face 1014 to ensure that the piston is unbalanced and that unequal forces are acting to move the position to the open position.

Figure 11A:
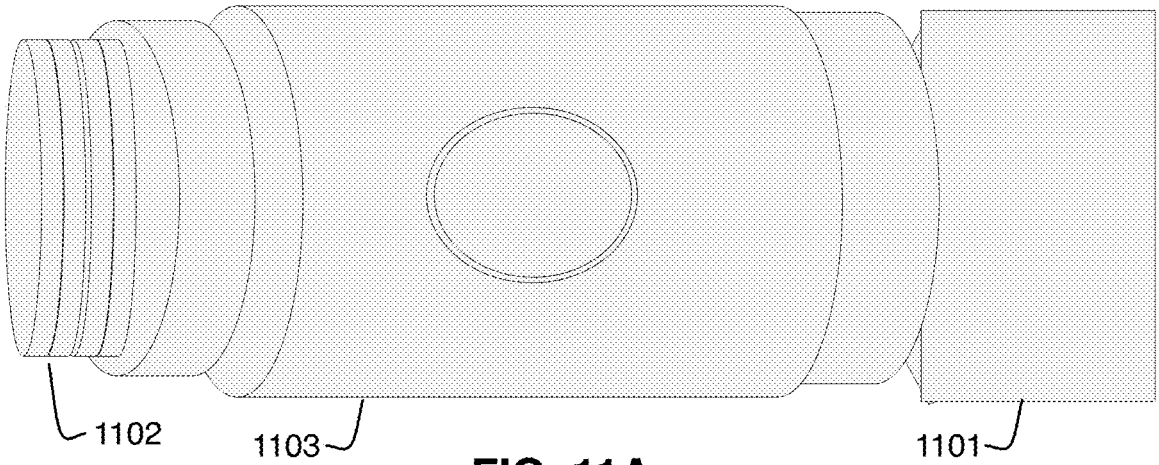
FIGS. 11A-11C depict the exterior of a temperature actuated sleeve run as a subassembly with box and pin threads.
Figure 11B:
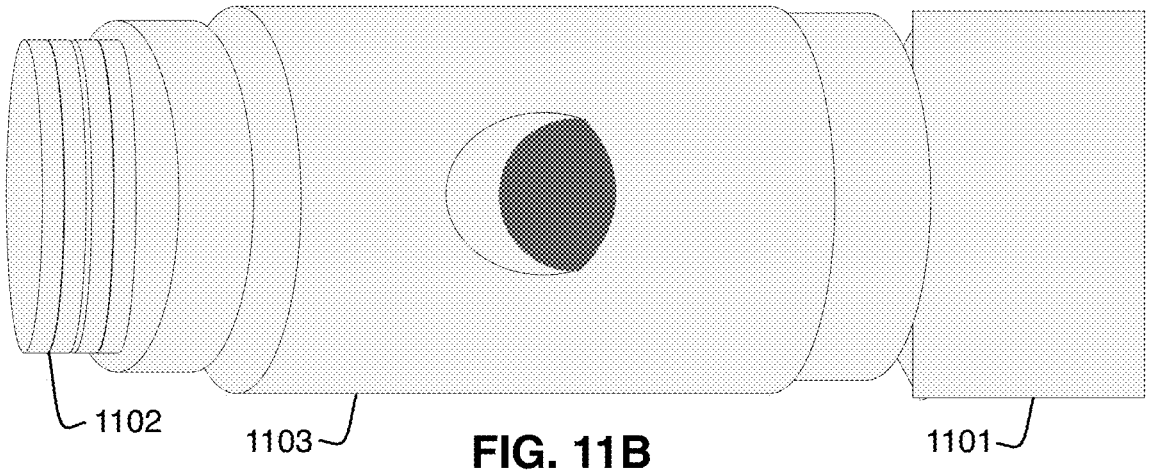
Figure 11C:
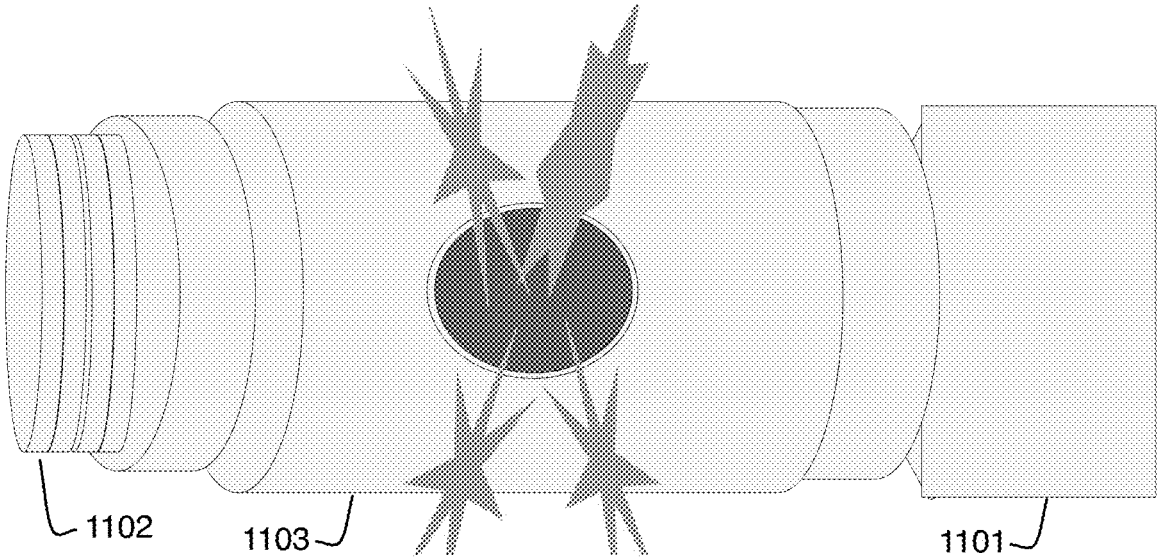

FIGS. 11A-11C depict the mechanics of the shifting sleeves 907 and 1007 adapted to be configured as an individual subassembly 1103 with a box thread 1101 for receiving casing joint pin threads, and pin threads 1102 for threading into a box thread of another casing joint. FIG. 11A illustrates the sleeve in the closed position. FIG. 11B shows the sleeve starting to open. FIG. 11C illustrates the sleeve fully opened with fluid communicating exterior to the sleeve.

Figure 12A:
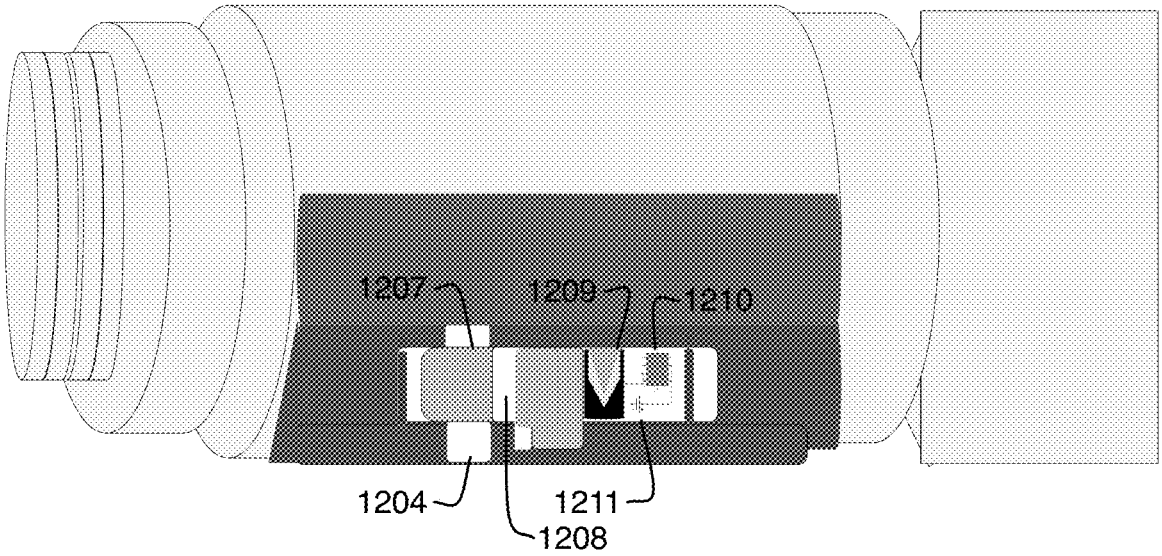
FIGS. 12A-12B depict a sleeve using an unbalanced piston run as a subassembly with box and pin threads.
Figure 12B:
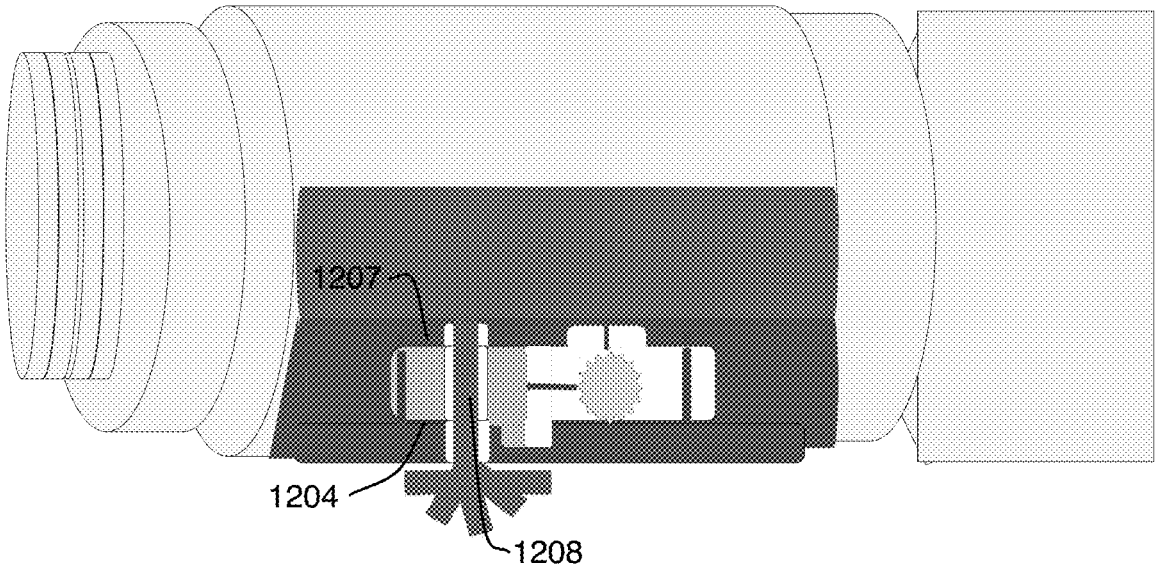

FIGS. 12A and 12B show a side cutaway view of the sleeve mechanics previously described in FIGS. 9C and 9D (with like reference numbers) that have been adapted to be actuated as part of subassembly 1103.

Figure 13A:
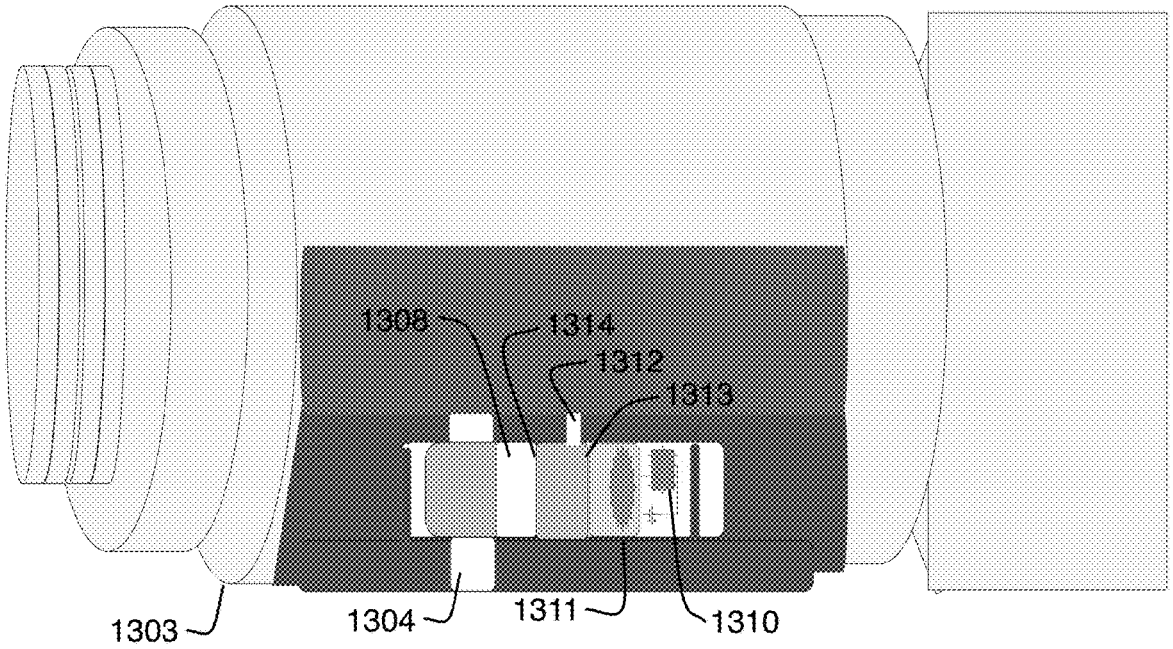
FIGS. 13A-13B depict a sleeve using a pressure actuated piston run as a subassembly with box and pin threads.
Figure 13B:
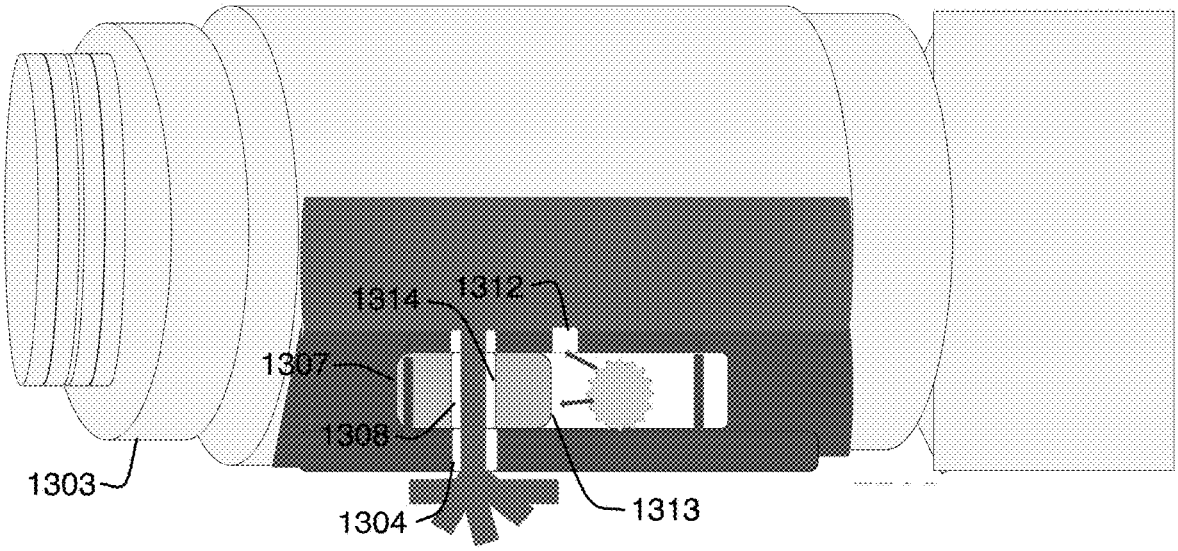

FIGS. 13A and 13B illustrate a side cutaway view of the sleeve mechanics previously described in FIGS. 10A and 10B (with like reference numbers) adapted to be actuated as part of threaded subassembly 1303.

Remote Isolation Mechanism

As described above, it may be desirable to provide an isolation mechanism between stages during fracturing operations. Conventionally this has been done with various mechanisms, including progressively sized balls landing on correspondingly sized ball seats deployed within the well. Such conventional arrangements may be used with the perforating sleeve designs described above. Alternatively, fracturing operations efficiency may be improved by providing a remote isolation mechanism that includes a temperature responsive ball seat as described below with reference to FIGS. 14A and 14B.

Figure 14A:
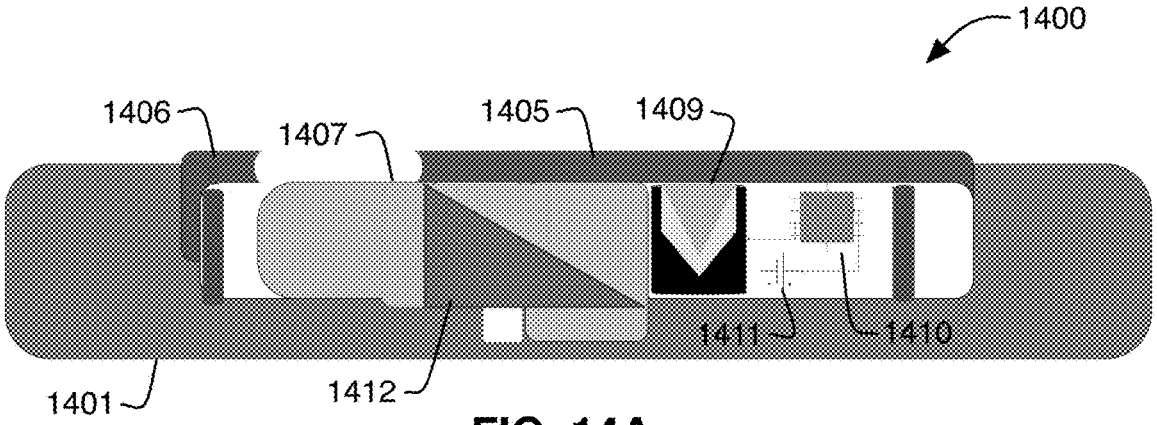
FIGS. 14A-14D depict a remote isolation mechanism.
Figure 14B:
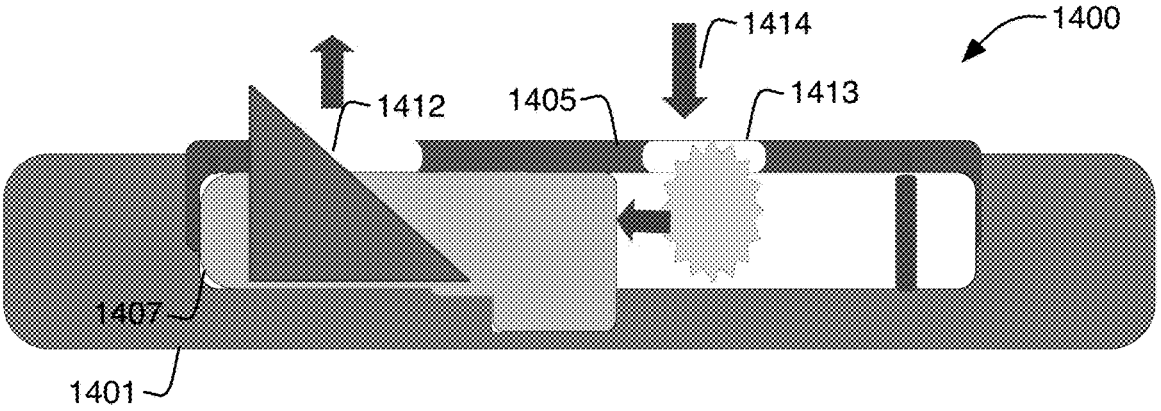

FIG. 14A illustrates a remote isolation mechanism 1400 in the retracted position. FIG. 14B illustrates remote isolation mechanism 1400 in the shifted position. Remote isolation mechanism 1400 may be constructed generally similarly to the sleeve described above with respect to FIGS. 9A-10B and 13A-13B. More specifically, a casing 1400 can have a recess formed therein for receiving remote isolation mechanism 1400 or the shifting mechanism can be built into a threaded subassembly. Remote isolation mechanism 1400 can include a housing 1405 secured to casing 1401 with fasteners 1406. Within housing may be a piston 1407. Piston 1407 may be an unbalanced piston that is triggered by controller 1410. More specifically, a power supply 1411 (e.g., a battery) may provide power to a controller 1410, which may be a discrete circuit of logic components, a microcontroller, a microprocessor, or other suitable control device. In some embodiments, controller 1410 may respond to a temperature sensor (not shown) and may be programmed to operate as described above with respect to FIG. 2.

Controller 1410 may be configured to trigger an explosive 1409, which may be configured to open a port 1413 (FIG. 14B) in housing 1405. This can allow well bore pressure 1414 to act on unbalanced piston 1407, shifting piston 1407, which in turn shifts collapsible ball seat 1412 into the ID of the casing. This can allow an object dropped or pumped down from the surface to land on collapsible seat 1412 and form a pressure seal between hydraulic fracturing stages.

Figure 14C:
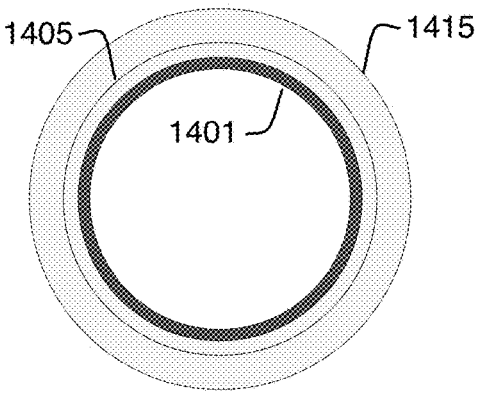
Figure 14D:
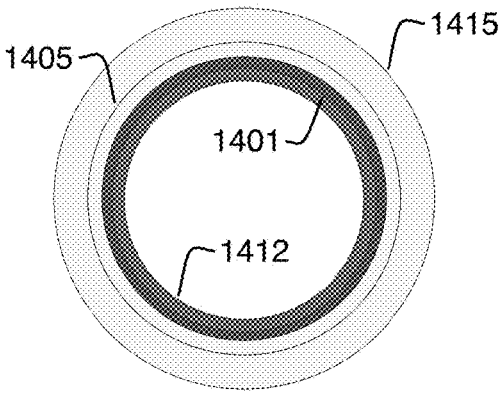

FIGS. 14C and 14D illustrate sectional views of remote isolation mechanism 1400 disposed in a wellbore 1415. FIG. 14C shows remote isolation mechanism 1400 in the retracted position, and FIG. 14D shows remote isolation mechanism 1400 in the extended position. In the retracted position, the full diameter of casing 1401 is unobstructed. Thus, the wellbore is not restricted when remote isolation mechanism 1400 is run in-hole or during cementing operations. When remote isolation mechanism 1400 is triggered (for example by seeing the same temperature cycling as the perforating sleeves described above), seat 1412 moves into the wellbore to allow a dropped or pumped down object, such as a dart or ball, to form a pressure seal.

Operating Sequence

FIGS. 15A-15F illustrates a completion sequence using two, single cluster perforating sleeves 1501, 1502 and two remote isolation mechanisms 1503, 1504, which may be constructed as described above. Initially, a string comprising at least a plurality of casing joints, perforating sleeves 1501 and 1502, and remote isolation mechanisms 1502 and 1504 are run into the well. Once this assembly is cemented in place, a first frac stage is pumped through perforating mechanism 1505. Perforating mechanism 1505 may be a perforating sleeve as described herein or may be another mechanism, such as a sliding sleeve, a perforated casing section, etc. Isolation for this first frac stage may be by a conventional isolation mechanism or the remote isolation mechanism described above, neither of which is shown in FIGS. 15A-15F.

As will be appreciated, once the wellbore assembly is run into the well, it will come to thermal equilibrium at a temperature substantially corresponding to the wellbore temperature. The pumping of the first frac stage will cause a first temperature cycle as described above with respect to FIG. 2. In other words, during pumping of the first frac stage, the wellbore assembly will reach thermal equilibrium at a temperature substantially corresponding to the temperature of the frac water. When the first frac stage is complete, the wellbore assembly will return to a temperature substantially corresponding to the formation temperature. Thus, after the first frac stage is over remote isolation mechanism 1503 may be triggered by the rise in temperature and the predetermined number of cycles. Remote isolation mechanism 1503 may then shift to create a restriction in the well bore for an object 1506 (FIG. 15B) dropped or pumped down from the surface to seat on 1503.

Figure 15A:
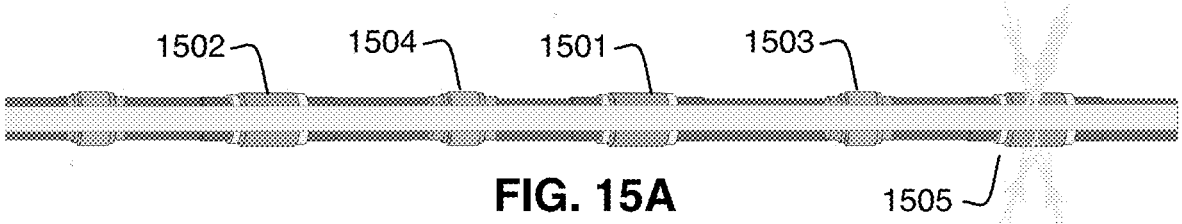
FIGS. 15A-15F depict the operating sequence of a frac completion using perforating sleeves and remote isolation mechanisms.
Figure 15B:
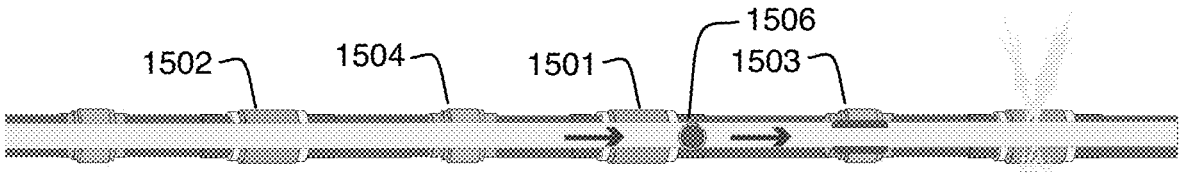
Figure 15C:
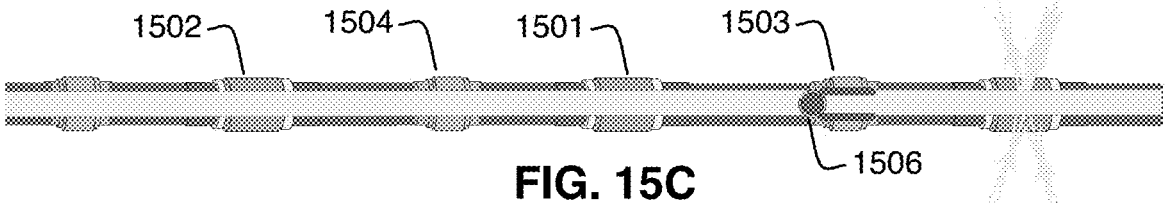
Figure 15D:
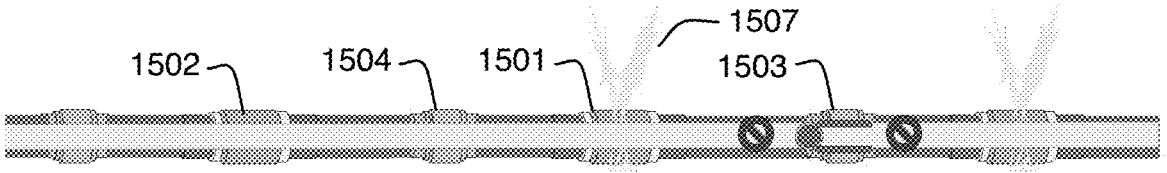
Figure 15E:
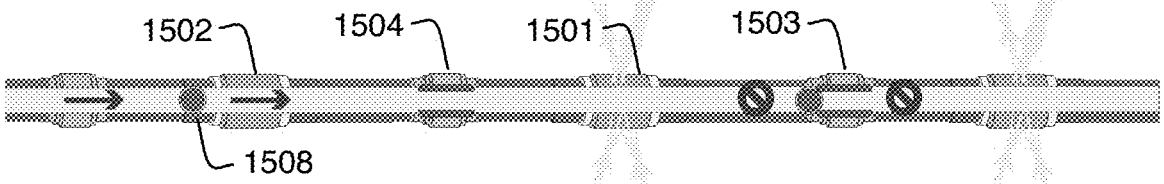
Figure 15F:
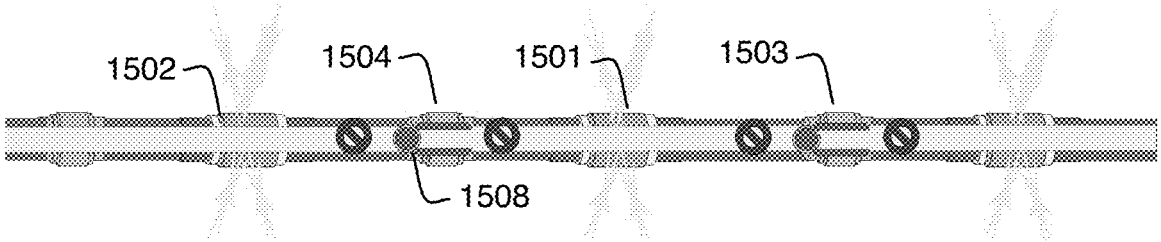

Once object 1506 seats (FIG. 15C), pressure from surface will keep the object on seat, creating a pressure seal between the first stage and the second stage (corresponding to perforating sleeve 1501 and remote isolation mechanism 1503). Perforating sleeve 1501 may be triggered by the same temperature cycle that triggered remote isolation mechanism 1503, thus allowing fluid communication between the interior of the casing and the wellbore. The second may thus be fractured (1507) through perforating sleeve 1501 (FIG. 15D). This fracturing operation will trigger a further temperature cycle that can trigger remote isolation mechanism 1504 and perforating sleeve 1502. The triggering of remote isolation mechanism 1504 can provide a landing for dropped/pumped down object 1508 (FIG. 15E), which establishes pressure isolation for the third frac stage through perforating sleeve 1502 (FIG. 15F).

Described above are various features and embodiments relating to temperature responsive devices for use in a fracturing a wellbore. Such temperature responsive devices may be used in a variety of applications, but may be particular advantageous when used in conjunction with fracturing operations, particularly simultaneous fracturing operations of multiple wells.

Additionally, although numerous specific features and various embodiments have been described, it is to be understood that, unless otherwise noted as being mutually exclusive, the various features and embodiments may be combined in any of the various permutations in a particular implementation. Thus, the various embodiments described above are provided by way of illustration only and should not be constructed to limit the scope of the disclosure. Various modifications and changes can be made to the principles and embodiments herein without departing from the scope of the disclosure and without departing from the scope of the claims.

The invention claimed is:

1. A method of fracturing a well, the method comprising:

disposing within the well at least a first temperature responsive device and a second temperature responsive device, wherein:

the first temperature responsive device comprises a trigger circuit configured to establish fluid communication through a casing of the well responsive to a f downhole temperature above a first threshold following a first predetermined number of downhole temperature cycles having a first predetermined time period; and the second temperature responsive device comprises a second trigger circuit configured to establish fluid communication through the casing of the well responsive to detection of a second downhole temperature above a second threshold following a second predetermined number of downhole temperature cycles having a second predetermined time period;

pumping a first frac stage, thereby lowering the downhole temperatures for at least the first predetermined time period, the lowering downhole temperatures for the first predetermined period temperature being detected by each of the trigger circuits;

stopping pumping of the first frac stage, thereby allowing the downhole temperatures to increase, the increased temperatures being detected by each of the trigger circuits;

pumping a second frac stage, thereby lowering downhole temperatures for at least the second predetermined time period, the lowering downhole temperatures being detected by each of the trigger circuits; and stopping pumping of the second frac stage, thereby allowing the downhole temperatures to increase, the increased temperatures being detected by each of the trigger circuits;

wherein the first temperature responsive device is configured to establish fluid communication through the casing upon detecting the first predetermined number of temperature cycles associated with the first frac stage and the first downhole temperature exceeding the first threshold; and wherein the second temperature responsive device is configured to establish fluid communication through the casing upon detecting the second predetermined number of temperature cycles associated with the second frac stage and the second downhole temperature exceeding the second threshold.

2. The method of claim 1 wherein the downhole temperatures are at least one of a casing temperatures or wellbore fluid temperatures.

3. The method of claim 1 wherein at least one of the first and second temperature responsive devices triggers is configured to establish fluid communication through the casing by detonating an explosive.

4. The method of claim 3 wherein detonating the explosive creates pressure to shift a sleeve.

5. The method of claim 3 wherein detonating the explosive allows well pressure to shift an unbalanced piston.

6. The method of claim 1 wherein at least one of the first and second temperature responsive devices is configured to establish fluid communication through the casing by initiating at least one of a thermal cutting device, an incendiary cutting device, or a chemical cutting device.

7. The method of claim 1 wherein at least one of the temperature responsive devices comprises a perforating sleeve adapted to be installed around the outside of a casing joint.

8. The method of claim 1 wherein at least one of the temperature responsive devices comprises a sub adapted to be threaded between two casing joints.

9. The method of claim 1 wherein at least one of the temperature responsive devices comprises a perforating device embedded within a casing joint.

10. The method of claim 1 further comprising:

disposing within the well, between the first and second temperature responsive devices, at least one temperature responsive isolation mechanism comprising a sub configurable to form a pressure barrier between frac stages and a trigger circuit configured to establish isolation between at least two well zones responsive to the second downhole temperature above the second threshold following the second predetermined number of downhole temperature cycles having a second predetermined time period.

11. The method of claim 10 wherein the trigger circuit of the isolation mechanism is configured to detonate an explosive to establish isolation between at least two well zones.

12. The method of claim 10 wherein the trigger circuit of the isolation mechanism is configured to create a pressure imbalance to shift a sleeve.

13. The method of claim 10 wherein the isolation mechanism is configured to form the pressure barrier between frac stages by establishing a ball seat configured to receive a ball dropped from the surface.

14. A wellbore assembly comprising:

a first temperature responsive device configured to be part of a casing string, the first temperature responsive device including a trigger circuit configured to establish fluid communication through the casing string responsive to a first downhole temperature above a first threshold following a first predetermined number of downhole temperature cycles having a first predetermined time period, the first predetermined number of temperature cycles being caused by the pumping of one or more frac stages that lower the downhole temperature; and a second temperature responsive device configured to be part of the casing string, the second temperature responsive device including a second trigger circuit configured to establish fluid communication through the casing string responsive to detection of a second downhole temperature above a second threshold following a second number of downhole temperature cycles having a second predetermined time period, the second predetermined number of temperature cycles being caused by the pumping of one or more frac stages that lower the downhole temperature; and wherein at least one of the first and second temperature responsive devices is a perforating sleeve adapted to be installed around the outside of a casing joint.

15. The wellbore assembly of claim 14 further comprising:

at least one temperature responsive isolation mechanism comprising a sub configurable to form a pressure barrier between frac stages and a trigger circuit configured to establish isolation between at least two well zones responsive to detection of the second downhole temperature above the second threshold following the second number of downhole temperature cycles having the second predetermined time period, the second predetermined number of temperature cycles being caused by the pumping of one or more frac stages that lower the downhole temperature.

16. The wellbore assembly of claim 14 wherein at least one of the first and second temperature responsive devices is configured to detonate an explosive to establish fluid communication through the casing of the well.

17. The wellbore assembly of claim 14 wherein at least one of the first and second temperature responsive devices is configured to activate a thermal cutting device, an incendiary cutting device, or a chemical cutting device to establish fluid communication through the casing of the well.

18. A temperature responsive completion device configured to be part of a wellbore casing string, the device comprising a trigger circuit configured to establish fluid communication through a casing of the well by detonating an explosive responsive to a downhole temperature above a first threshold following a first predetermined number of downhole temperature cycles having a first predetermined time period, the first predetermined number of temperature cycles being caused by the pumping of one or more frac stages that lower the downhole temperature; and wherein the explosive is a shaped charge.

19. The temperature responsive completion device of claim 18 wherein the temperature responsive device is a perforating sleeve adapted to be installed around the outside of a casing joint.

20. The temperature responsive completion device of claim 18 wherein the temperature responsive device is a sub adapted to be threaded between two casing joints.

21. The temperature responsive completion device of claim 18 wherein the trigger circuit comprises a temperature sensor, a controller, and a plurality of capacitors.

22. The temperature responsive completion device of claim 18 wherein the shaped charge ruptures a burst disk.

* * * * *